US009401550B2

(12) United States Patent
Sakamoto

(10) Patent No.: US 9,401,550 B2
(45) Date of Patent: Jul. 26, 2016

(54) CONNECTOR

(71) Applicant: IRISO ELECTRONICS CO., LTD., Kanagawa (JP)

(72) Inventor: Tetsuma Sakamoto, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/711,031

(22) Filed: May 13, 2015

(65) Prior Publication Data

US 2016/0118729 A1 Apr. 28, 2016

(30) Foreign Application Priority Data

May 20, 2014 (JP) ..... 2014-104631

(51) Int. Cl.

*H01R 12/00* (2006.01)
*H01R 12/51* (2011.01)
*H01R 13/11* (2006.01)

(52) U.S. Cl.

CPC ..... *H01R 12/51* (2013.01); *H01R 13/112* (2013.01)

(58) Field of Classification Search

CPC .. H01R 12/51; H01R 13/112; H01R 12/7005; H01R 12/52; H01R 12/7082; H01R 13/716
USPC ..... 439/78
See application file for complete search history.

(56) References Cited

U.S. PATENT DOCUMENTS 5,181,855 A * 1/1993 Mosquera ..... H01R 13/28 439/291
5,376,009 A * 12/1994 Olsson ..... H01R 23/662 361/785
5,542,851 A * 8/1996 Chikano ..... H01R 23/6873 439/108
5,618,191 A * 4/1997 Chikano ..... H01R 12/716 439/108
5,921,787 A 7/1999 Pope et al.
6,257,901 B1 * 7/2001 Torii ..... H01R 12/7082 439/74
6,623,308 B2 * 9/2003 Ono ..... H01R 13/26 439/660

(Continued)

FOREIGN PATENT DOCUMENTS

EP 2610971 A1 7/2013
JP 03-226976 A 10/1991

(Continued)

OTHER PUBLICATIONS

Office Action for Japanese Patent App. No. 2014-104631 (Jan. 13, 2015).

(Continued)

*Primary Examiner* — Jean F Duverne
(74) *Attorney, Agent, or Firm* — Cermak Nakajima & McGowan LLP; Tomoko Nakajima

(57) ABSTRACT

Socket terminals include flat bar-like connection pieces that are in conductive contact with plug terminals, and the plug terminals include fork-shaped terminal portions that are in conductive contact with the socket terminals through the flat bar-like connection pieces. Plate surfaces of the plug terminals extend in a height direction and are fixed to a plug housing. Furthermore, fork-shaped terminal portions include contact recesses having openings in plate edges on a socket terminal insertion side. Contact projections of the contact recesses hold the flat bar-like connection pieces of the socket terminals that have been inserted through the openings in between in a direction (an up-down direction) that extends along the plate surfaces of the plug terminals.

14 Claims, 21 Drawing Sheets

(56) References Cited

U.S. PATENT DOCUMENTS

| | | | | |
|---|---|---|---|---|
| 7,004,763 | B2 * | 2/2006 | Ma | H01R 12/52 439/636 |
| 7,540,770 | B2 * | 6/2009 | Ishizuka | H01R 12/7005 439/353 |
| 2014/0226295 | A1 | 8/2014 | Nishio et al. | |

FOREIGN PATENT DOCUMENTS

| | | | |
|---|---|---|---|
| JP | 11-026103 | A | 1/1999 |
| JP | 2003-173834 | A | 6/2003 |
| JP | 2006-012717 | A | 1/2006 |
| JP | 2007-066890 | A | 3/2007 |
| JP | 2007-134217 | A | 5/2007 |
| JP | 2008-153074 | A | 7/2008 |
| JP | 2010-153080 | A | 7/2010 |
| WO | WO2013/051076 | A1 | 4/2013 |

OTHER PUBLICATIONS

European Search Report for European Patent App. No. 15168014.7 (Sep. 15, 2015).

* cited by examiner

CONNECTOR

BACKGROUND OF THE INVENTION

1. Field of the Invention

The present disclosure relates to a connector including a plug connector and a socket connector.

2. Description of the Related Art

In electric devices, a connector that includes a plug connector that is fixed to a circuit board and a socket connector that is fixed to a conductor is used as a connector that electrically connects a conductor, such as an electric wire, and a circuit board. In such a connector, typically, pin-shaped plug terminals are provided in the plug connector, and socket terminals that are in conductive contact with the plug terminals are provided in the socket connector (as an example of the same type of connector, Japanese Unexamined Patent Application Publication No. 2007-134217). The above socket terminals are each provided with a box-shaped storage portion in which the pin-shaped plug terminal is inserted and retained, and the socket terminals described above accommodate the pin-shaped plug terminals in the storage portions while fixed to the distal ends of the conductors. With such a configuration, the plug terminals and the socket terminals can reliably be in conductive contact with each other.

SUMMARY OF THE INVENTION

Incidentally, the above connector is, in some cases, used to connect an on-vehicle electronic equipment and the like to a battery and the like that are mounted on a vehicle, for example. In recent years, in order to achieve reduction in size and weight of the vehicle, the connector itself is required to save space. Particularly, the connector is required to further reduce the area occupied when mounted on a circuit board.

However, in the connector described above, the box-shaped storage portions of the socket terminals are each typically formed by bending a metal piece forming the socket terminal into a complicated box shape, such as a square tube shape or a cylindrical shape; accordingly, a large internal space that accommodates the socket terminals is needed inside the socket connector making it difficult to reduce the size of the overall connector. Accordingly, when the storage portions are provided in the socket terminals, disadvantageously, it is difficult to reduce the area occupied by the circuit board.

The present disclosure has been made under the above background of the conventional art. An object of the present disclosure is to provide a small connector that has high connection reliability and that is capable of reducing the area occupied by the circuit board.

In order to achieve the above object, the present disclosure is configured in the following manner.

That is, the present disclosure provides a connector including a plug connector including a plug housing and a plurality of plug terminals, the plug connector being fixed to a circuit board; and a socket connector including a socket housing that is fitted to the plug housing, and a plurality of socket terminals that are in conductive contact with the plug terminals. The socket terminals include flat bar-like connection pieces that are in conductive contact with the plug terminals. The plug terminals are formed of flat plate-shaped metal pieces, are fixed to the plug housing while plate surfaces of the plug terminals extend in a height direction of the plug housing, and include terminal portions that are in conductive contact with the socket terminals. The terminal portions are formed in recessed shapes that have openings in plate edges of the flat plate-shaped metal pieces on a socket terminal insertion side, and the terminals include contact recesses that are, by holding the flat bar-like connection piece between the contact recesses in a direction extending along the plate surface of the plug terminals, in conductive contact with the flat bar-like connection pieces of the socket terminals that have been inserted through the openings.

The plug terminals of the present disclosure are formed of flat plate-shaped metal pieces and the plug terminals are fixed to the plug housing while plate surfaces of the plug terminals extend in a height direction of the plug housing. Compared to a case in which the plate surfaces of the plug terminals formed of the flat plate-shaped metal pieces are disposed horizontally, the present disclosure can reduce the size of the plug connector in the arrangement direction of the plug terminals.

The socket terminals include flat bar-like connection pieces that are in conductive contact with the plug terminals, and the plug terminals include terminal portions that are in conductive contact with the flat bar-like connection pieces of the socket terminals. The terminal portions include contact recesses that are formed in recessed shapes that have openings in plate edges of the flat plate-shaped metal pieces on a socket terminal insertion side, and the contact recesses are in conductive contact with the flat bar-like connection pieces of the socket terminals that have been inserted through the openings, by holding the flat bar-like connection piece between the contact recesses in a direction extending along the plate surface of the plug terminals. By having the plug terminals formed of the flat plate-shaped metal pieces inserted through the openings of the contact recesses and by having the terminal portions hold the plug terminals therebetween, the plug terminals and the socket terminals can be made to be in conductive contact with each other in a reliable manner. Furthermore, by configuring the connection pieces of the socket terminals to have flat bar shapes, compared with a case in which the connection pieces of the socket terminals are provided as thin rods, for example, the connection pieces can be in conductive contact with the plug terminals in a more stable manner. Accordingly, since there is no need to form the complicated box-shaped storage portions by bending the metal pieces that form the socket terminals, the overall connector can be reduced in size and the connection reliability can be increased.

The terminal portions of the present disclosure may form fork-shaped terminal portions that branches into two forks, the fork-shaped terminal portions may include contact pieces that are capable of being displaced in the direction extending along the plate surface, and the contact recesses may be formed by recess-shaped plate edges provided between the contact pieces.

With the above configuration, the flat bar-like connection pieces of the socket terminals can be reliably held by a certain pressure with the recess-shaped plate edges provided between the elastically displaceable contact pieces.

The socket housing of the present disclosure may include interpolar walls that divide adjacent plug terminals from each other when in a state in which the socket housing is fitted together with the plug housing.

With the above configuration, even if the pitch between the plug terminals is made smaller, occurrence of short-circuiting can be suppressed without increasing the number of parts. Furthermore, at the same time, whisker prevention measures such as tin plating of the plug terminals can be performed.

The plug housing of the present disclosure may include first wall portions that restrict excessive displacement in directions widening the gaps between the contact pieces when the fork-shaped terminal portions are in conductive contact with the socket terminals.

When each contact piece are pushed by the corresponding flat bar-like connection piece, there are cases in which, due to twisting and oblique insertion, an abnormal push pressure acts on the contact piece causing the contact piece to be excessively displaced and plastically deformed such that the contact piece is unable to return its original state. In contrast, in the present disclosure, even if an abnormal push pressure described as above acting on the contact pieces displaces the contact pieces in a direction that widens the gap between the contact pieces, the contact pieces will abut against the first wall portions and the displacement will be restricted. With the above, a situation such as the contact pieces not returning to the regular contact position with respect to the flat bar-like connection piece will less likely occur. Furthermore, by partially covering the plug terminals with the first wall portions, foreign matter will less likely adhere to the plug terminals.

The plug housing of the present disclosure may include second wall portions that restrict deviating displacement of the contact pieces in a plate thickness direction when the flat bar-like connection pieces of the socket terminals are inserted into the contact recesses and are in conductive contact with the contact recesses.

When each contact piece are pushed by the corresponding flat bar-like connection piece, there are cases in which, due to twisting and oblique insertion, an abnormal push pressure acts on the contact piece causing the contact piece to be excessively displaced and plastically deformed such that the contact piece is unable to return its original state. In contrast, in the present disclosure, even if an abnormal push pressure described as above acting on the contact pieces displaces the contact pieces in a plate thickness direction, the contact pieces will abut against the second wall portions and the displacement will be restricted. As described above, a situation such as the contact pieces not returning to the regular contact position with respect to the flat bar-like connection piece will less likely occur. Furthermore, by forming the second wall portions between the plug terminals, adjacent plug terminals can be insulated from each other. Furthermore, by partially covering the plug terminals with the second wall portions, foreign matter will less likely adhere to the plug terminals.

The second wall portions of the present disclosure are formed on both sides of each of the connection pieces in a direction extending along the length direction of the contact pieces, and the pair of second wall portions are formed, with respect to each other, with an interval that is smaller than the plate width of the flat bar-like connection piece such that the plate surface of the flat bar-like connection piece that is inserted at the end portion of the second wall portions can be in sliding contact with the second wall portions.

With the above, when the plug housing and the socket housing are fitted together, the flat bar-like connection pieces of the socket terminals that are in sliding contact with the end portions of the second wall portions can be guided deep into the contact recesses. Furthermore, by providing a second wall portion to each of the two contact pieces included in the fork-shaped terminal portions, each of the flat plate-shaped surfaces of the flat bar-like connection piece comes in sliding contact with the opposing and corresponding second wall portions such that a certain insertion position is maintained. Accordingly, oblique insertion and twisting less likely occurs and a situation such as occurrence of plastic deformation and buckling of the contact pieces due to being pushed can be prevented from happening.

The socket housing of the present disclosure may include accommodation recesses that accommodate, between the adjacent interpolar walls, the contact pieces of the plug terminals and the second wall portions that are adjacent to the contact pieces, when in a state in which the socket housing is fitted together with the plug housing.

With the above, in a state in which the plug housing and the socket housing are fitted together, the portions between the adjacent plug terminals can be structurally insulated not only with the second wall portions but also with the interpolar walls. Furthermore, for example, by surrounding each of the contact pieces with the accommodation recess (the socket housing), the first wall portions, and the second wall portions (the plug housing), the portions between the plug terminals can be structurally insulated in a further robust manner. Accordingly, not only occurrence of short-circuiting between the plug terminals can be reliably suppressed, whisker prevention measures such as tin plating of the plug terminals can be performed in a reliable manner.

The contact pieces of the present disclosure may include, at the distal end side thereof, contact projections that project in a socket terminal contact direction so as to be in conductive contact with the flat bar-like connection pieces of the socket terminals, the contact projections including contact edges in which inclined surfaces continuously extend in multiple steps from a front side to a back side in an insertion direction of the flat bar-like connection pieces such that an angle of inclination of the inclined surfaces become smaller with respect to a line that extends in the insertion direction.

With the above, while the tips of the flat bar-like connection pieces are guided by the inclined surfaces towards the depth side in the insertion direction, the insertion force of each flat bar-like connection piece is dispersed to the inclined surfaces that have different angles of inclination. Accordingly, the flat bar-like connection pieces can be inserted into the contact recesses of the plug terminals with a further smaller insertion force to be in conductive contact with the contact projections.

The plug terminals of the present disclosure may include fixing pieces that extend in parallel to the fork-shaped terminal portions and that are fixed to the plug housing. With the above, without protruding the fixing pieces from the fork-shaped contact pieces in the plate thickness direction, the plug terminals can be fixed to the plug housing; accordingly, the connector can be configured compact in the arrangement direction of the plug terminals in a further reliable manner.

The plug terminals of the present disclosure may include board fixing pieces that are soldered to a plated circuit, and base portions that extend inside the plug housing from the board fixing pieces in the height direction, in which base ends of the terminal portions are connected to the base portions at a predetermined height.

In connectors in which the plug terminals are formed in pin shapes, typically, the plug terminals protrude to the outside from the back side positioned opposite the fitting ports at the front of the plug housing, and are bent towards the circuit board, and the end portions of the plug terminals on the board side are soldered to the plated circuit. Conversely, in the present disclosure, the plug terminals include the board fixing pieces, and includes base portions that extend inside the plug housing from the board fixing pieces in the height direction, in which base ends of the terminal portions are connected to the base portions at a predetermined height. With the above, since the plug terminals do not protrude to the outside of the plug housing, the overall connector can be reduced in size. Furthermore, by reducing the portions of the plug terminals that are exposed to the outside through the plug housing, damage of the plug terminals and foreign matter adhering to the plug terminals can be reduced.

The socket housing of the present disclosure may include terminal mounting holes of the socket terminals that are formed in two rows in the height direction and a retainer that locks all of the socket terminals that are accommodated in the terminal mounting holes in a releasing direction.

With the above, the plurality of socket terminals included in the connector can be collectively retained with a single retainer.

The socket terminals of the present disclosure may include tab portions provided on proximal end sides of the flat bar-like connection pieces, the tab portions locking the socket terminals with respect to the socket housing, and bead portions provided across the flat bar-like connection pieces and the tab portions.

With the above, the connection portions between the flat bar-like connection pieces and the tab portions can be reinforced.

The retainer of the present disclosure may include lock portions that lock the bead portions in the releasing direction.

With the above, the retainer can retain the socket terminals with respect to the socket housing without increasing the number of parts.

The terminal mounting holes of the socket housing of the present disclosure may have inner groove shapes that accommodate the socket terminals in two rows in the height direction while inverting the terminal mounting holes in the socket terminal insertion direction.

For example, the retainer may be formed symmetrically in the height direction of the connector, a lock portion used against the retainer may be provided on the upper portion or the lower portion of each socket terminal, and the socket terminals may be accommodated in an inverted manner in each of the terminal mounting holes provided in two rows in the height direction. With the above, the lock portions, used against the retainer provided in the socket terminals in two rows, may be arranged close to each other and the retainer may be disposed between the two socket terminal rows such that the socket terminals can be collectively retained more easily with a single retainer.

The connector of the present disclosure can make the connector more compact and, accordingly, can reduce the area occupied by the circuit board. Furthermore, since the plug terminals are in conductive contact with the flat bar-like connection pieces of the socket terminals by holding the flat bar-like connection pieces between the contact recesses, connection reliability can be increased.

BRIEF DESCRIPTION OF THE DRAWINGS

FIGS. 31A and 31B are cross-sectional plan views illustrating the retainer of FIG. 1 in which FIG. 31A illustrates a temporarily fixed state and FIG. 31B illustrates a locked state.

DESCRIPTION OF THE PREFERRED EMBODIMENTS

Hereinafter, an exemplary embodiment of the present disclosure will be described with reference to the drawings.

In the present description, claims, and drawings, a description will be given while a width direction that extends in a longitudinal direction of a connector 1 illustrated in FIGS. 1 to 34 is an X direction, a front-rear direction that extends in a short direction thereof is a Y direction, and a height direction of the connector 1 is a Z direction, and in the height direction Z, a top surface side of the connector 1 is an "upper side" and the bottom surface side of the connector 1 is a "lower side". Note that the up-down direction, the left-right direction, and the front-rear direction in the description do not limit the direction in which the connector of the present disclosure is used. Furthermore, since a right side view and a left side view of a plug terminal 5 will be illustrated in a bilaterally symmetrical manner, the left side view is omitted.

Exemplary Embodiment

FIGS. 1 to 34

The connector 1 of the present exemplary embodiment is specified for a surface mount (surface mount technology)

connector that is used to conductively connect linear conductors 2 such as electric wires and a circuit board 3 to each other. The connector 1 is used when connecting a piece of on-vehicle electronic equipment or the like and a battery or the like to each other, for example.

Figure 1:
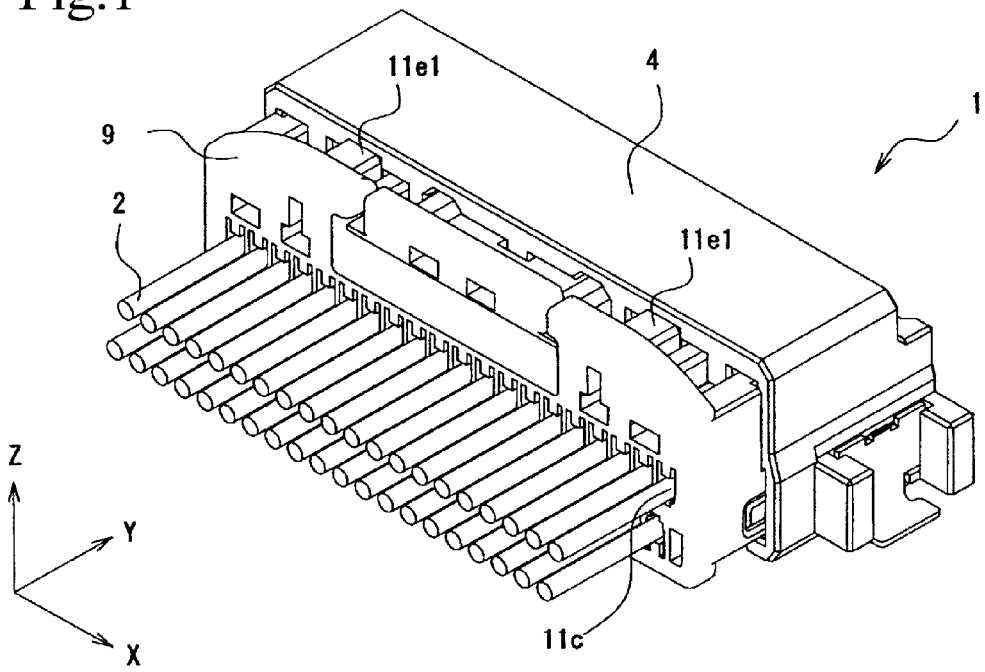
FIG. 1 is a perspective view illustrating a backside, a top side, and a left side of a connector of an exemplary embodiment.
Figure 2:
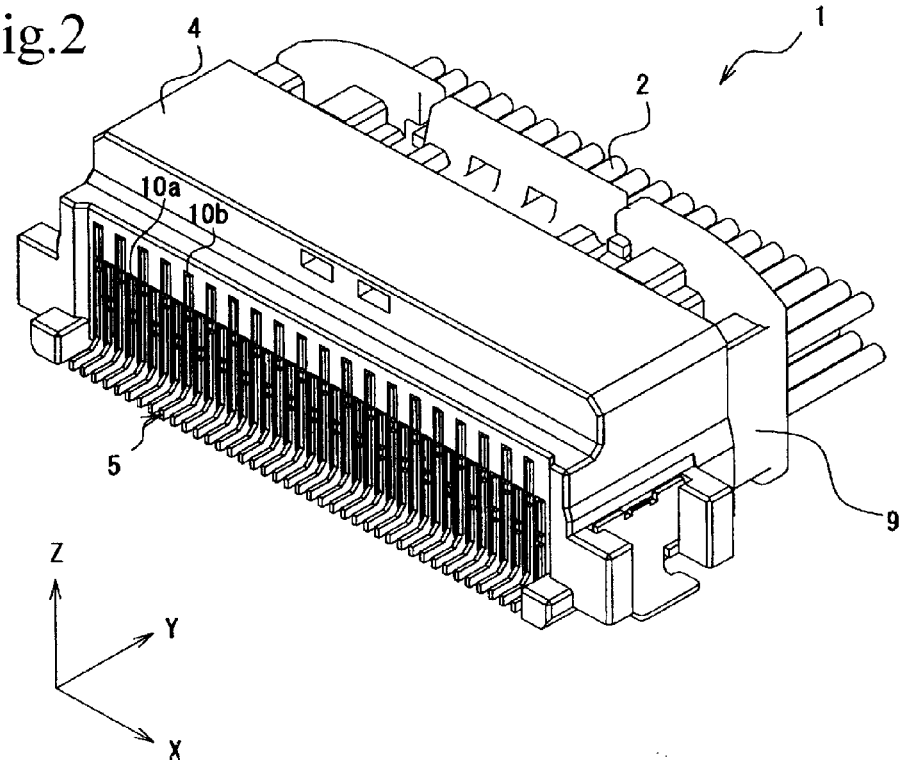
FIG. 2 is a perspective view illustrating a front side, the top side, and a right side of the connector of FIG. 1.
Figure 3:
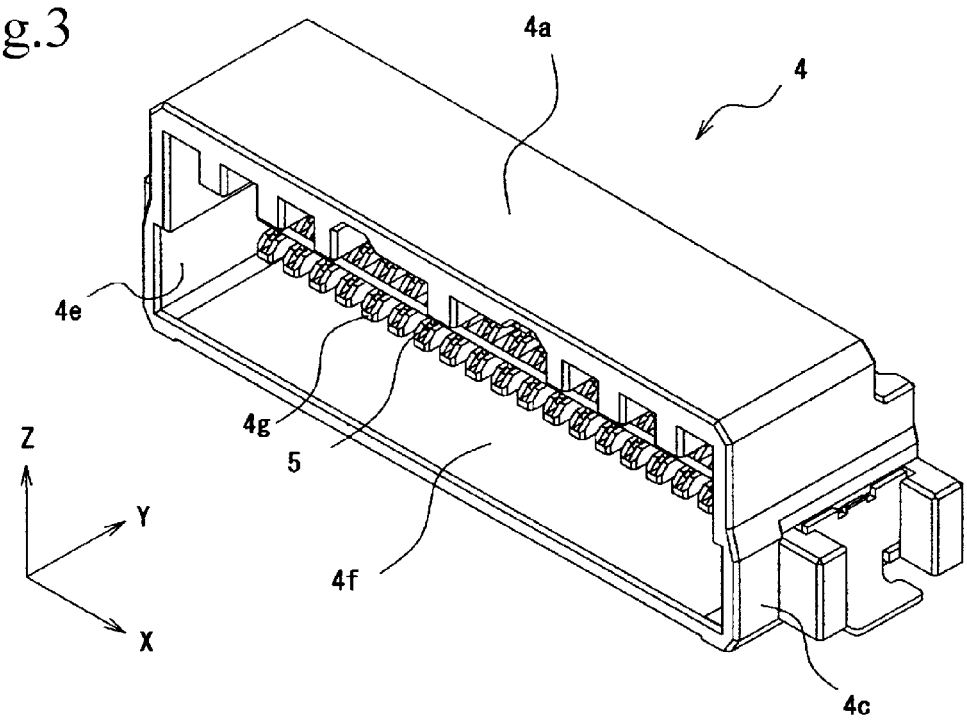
FIG. 3 is a perspective view illustrating a backside, a top side, and a left side of a plug connector of FIG. 1.
Figure 4:
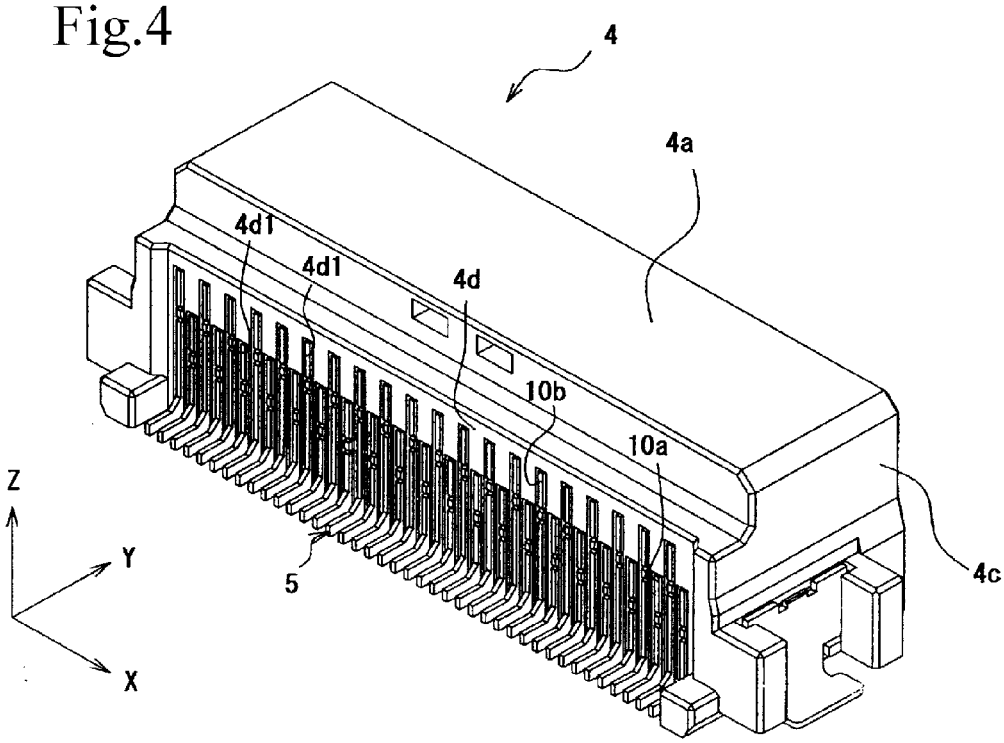
FIG. 4 is a perspective view illustrating a front side, the top side, and a right side of the plug connector of FIG. 1.
Figure 5:
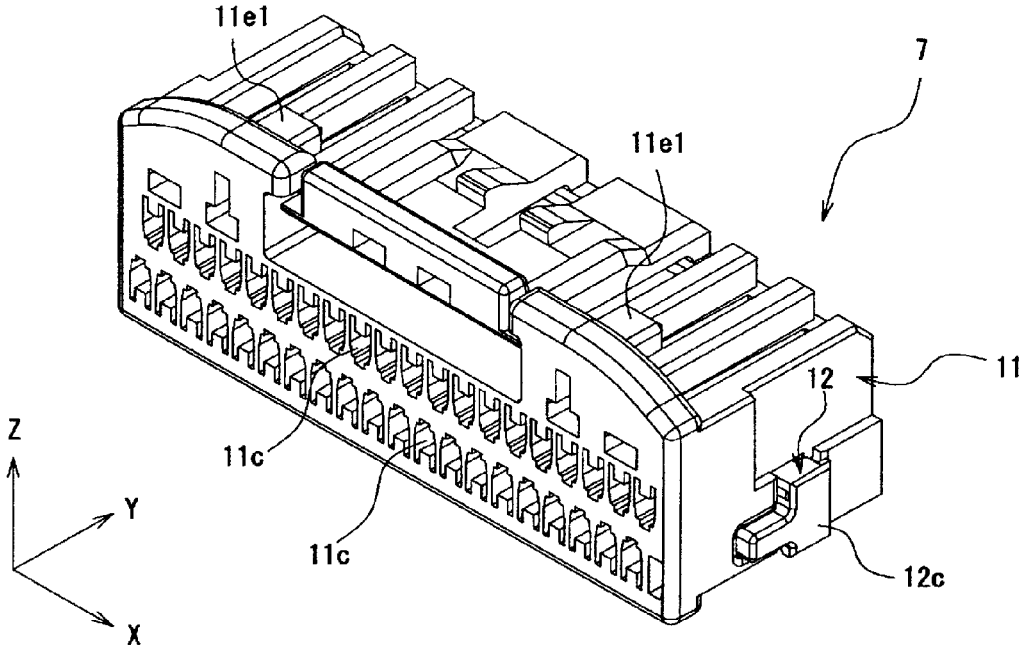
FIG. 5 is a perspective view illustrating a backside, a top side, and a left side of a socket housing of FIG. 1.
Figure 6:
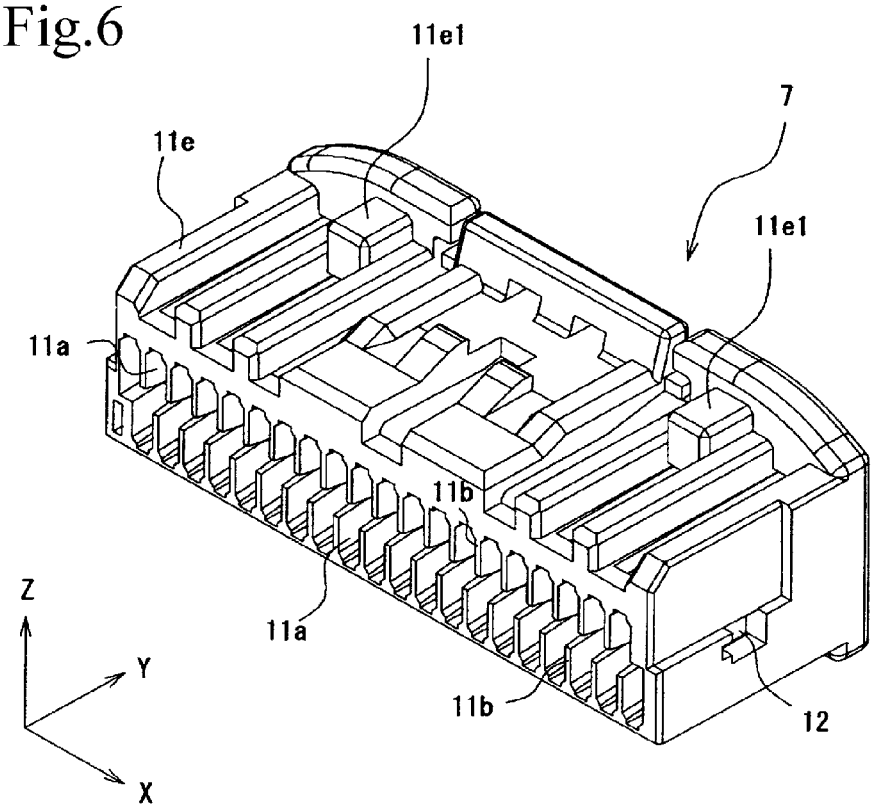
FIG. 6 is a perspective view illustrating a front side, the top side, and a right side of the socket housing of FIG. 1.
Figure 7:
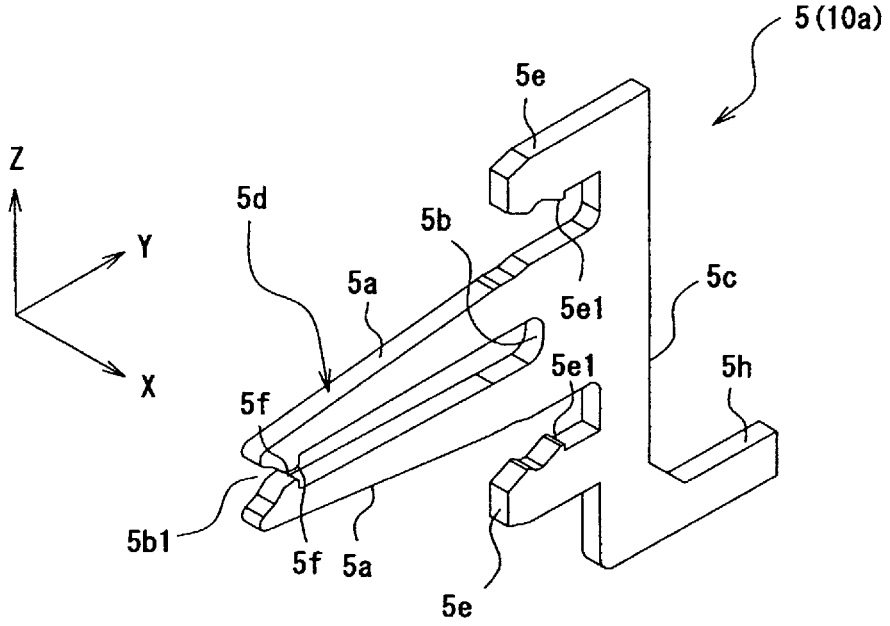
FIG. 7 is a perspective view illustrating a front side, a top side, and a right side of a plug terminal of FIG. 1.
Figure 8:
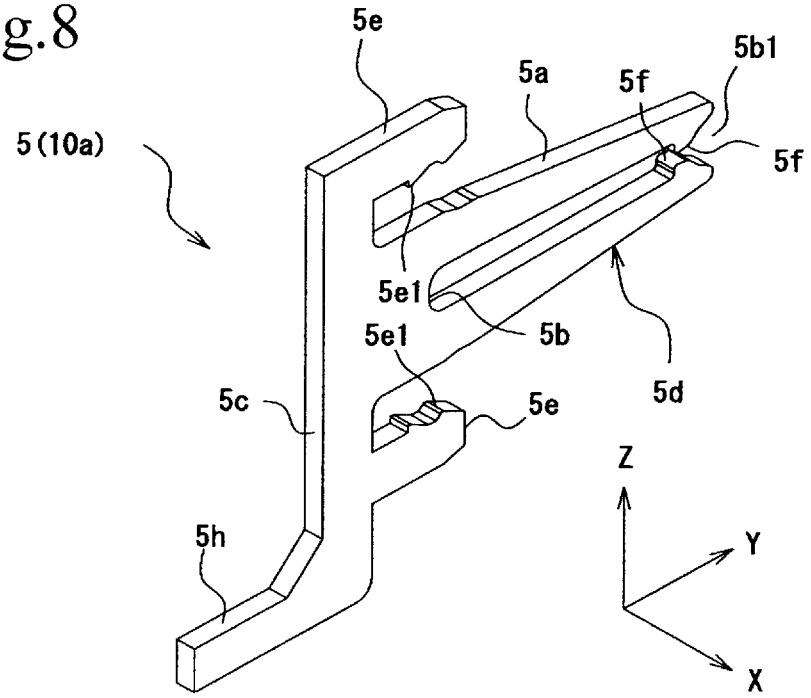
FIG. 8 is a perspective view illustrating a backside, the top side, and a left side of the plug terminal of FIG. 1.
Figure 9:
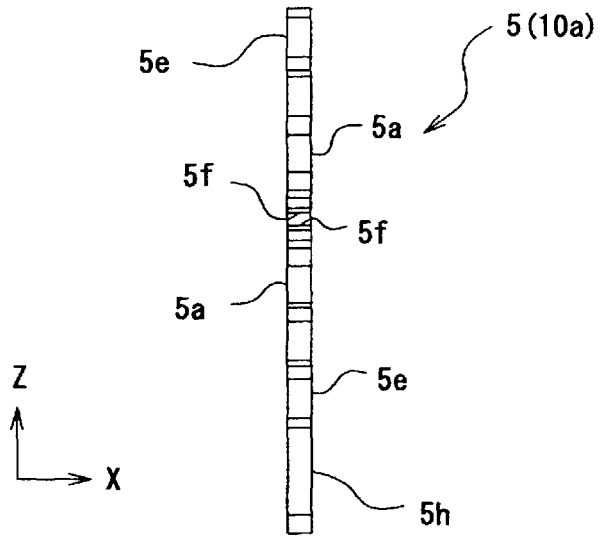
FIG. 9 is a front view of the plug terminal of FIG. 1.
Figure 10:
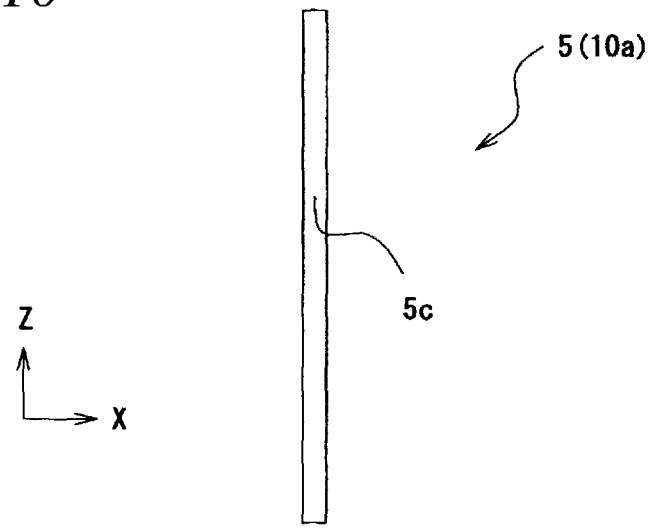
FIG. 10 is a rear view of the plug terminal of FIG. 1.
Figure 11:
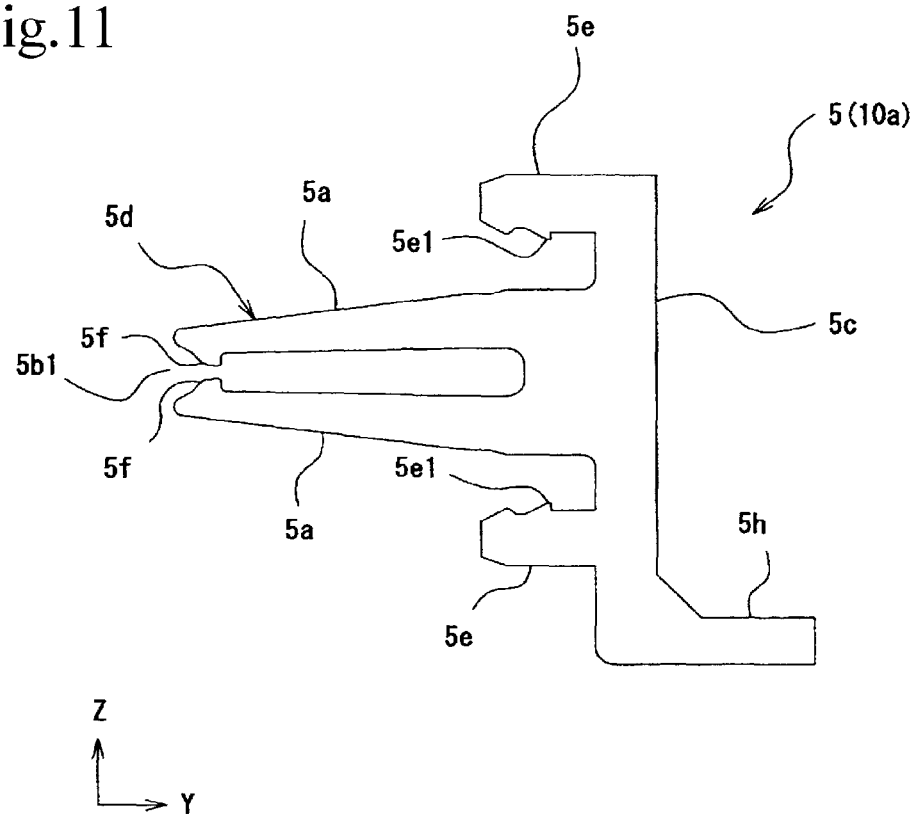
FIG. 11 is a right side view of the plug terminal of FIG. 1.
Figure 12:
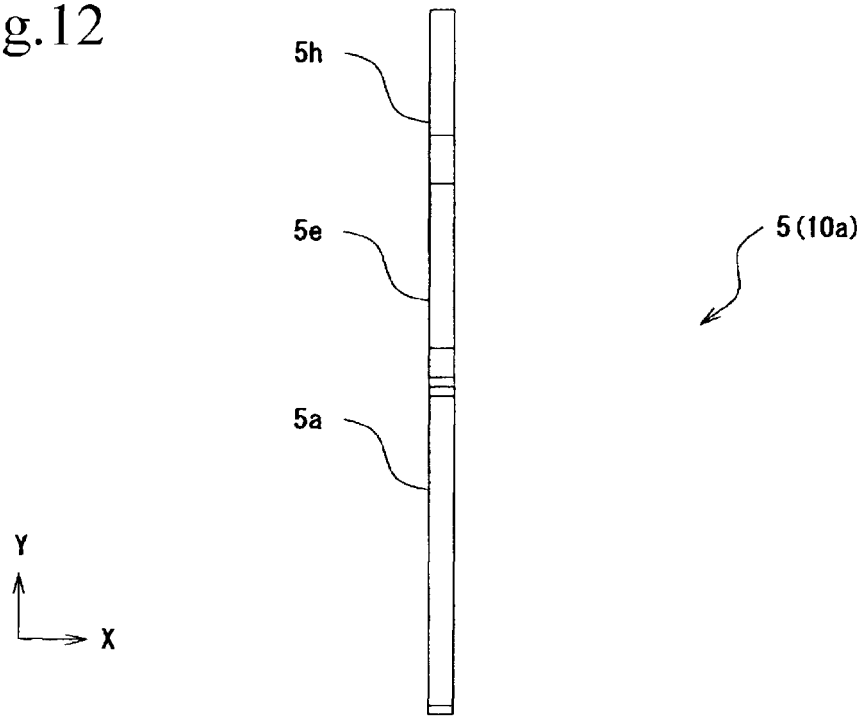
FIG. 12 is a plan view of the plug terminal of FIG. 1.
Figure 13:
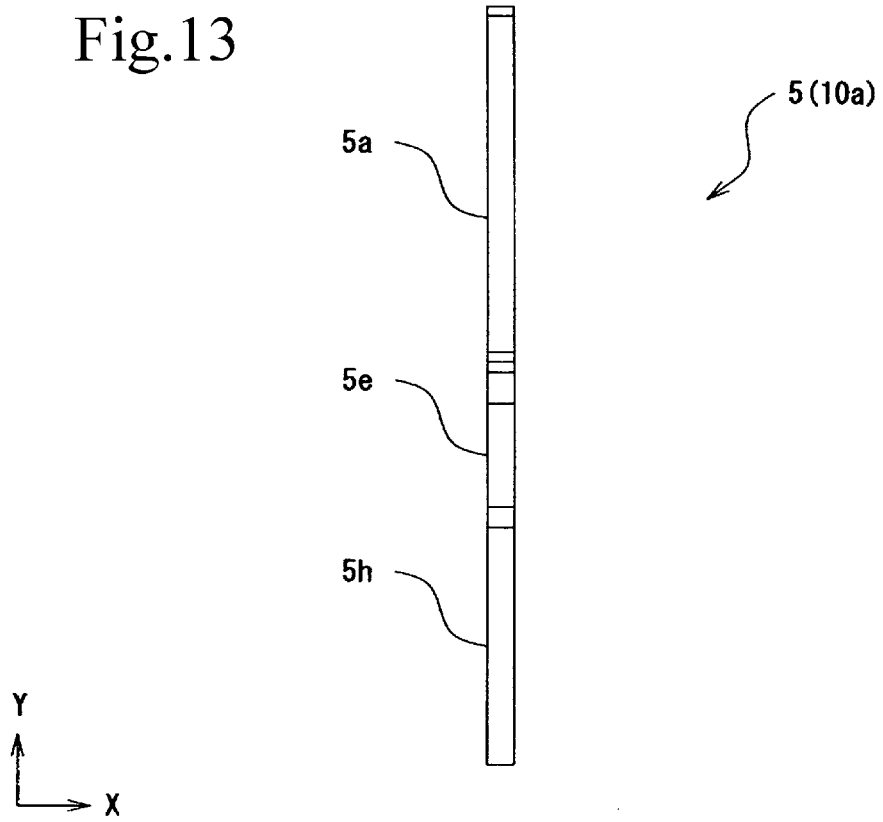
FIG. 13 is a rear view of the plug terminal of FIG. 1.
Figure 14:
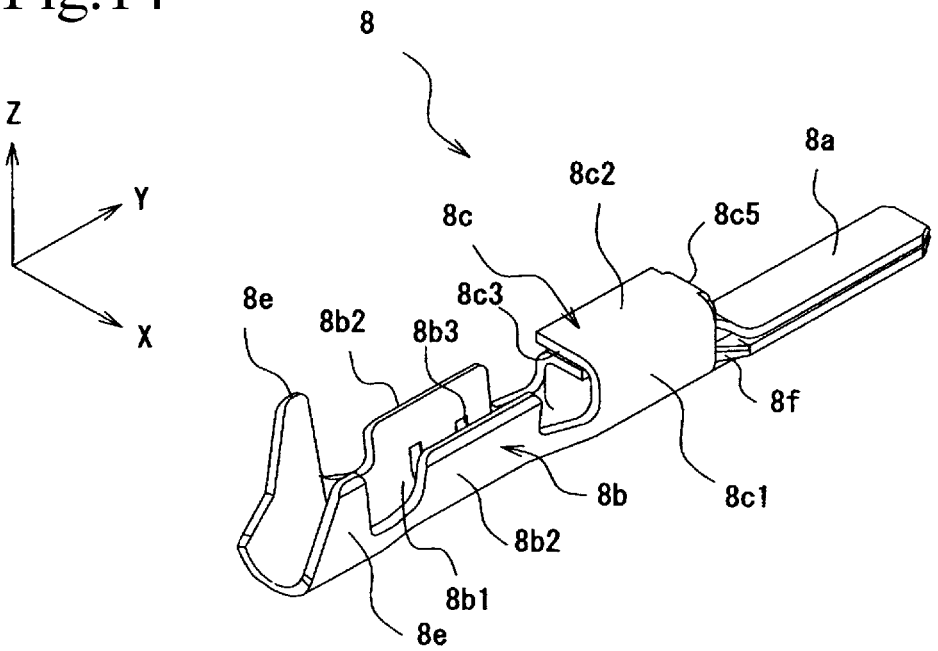
FIG. 14 is a perspective view illustrating a front side, a top side, and a right side of a socket terminal of FIG. 1.
Figure 15:
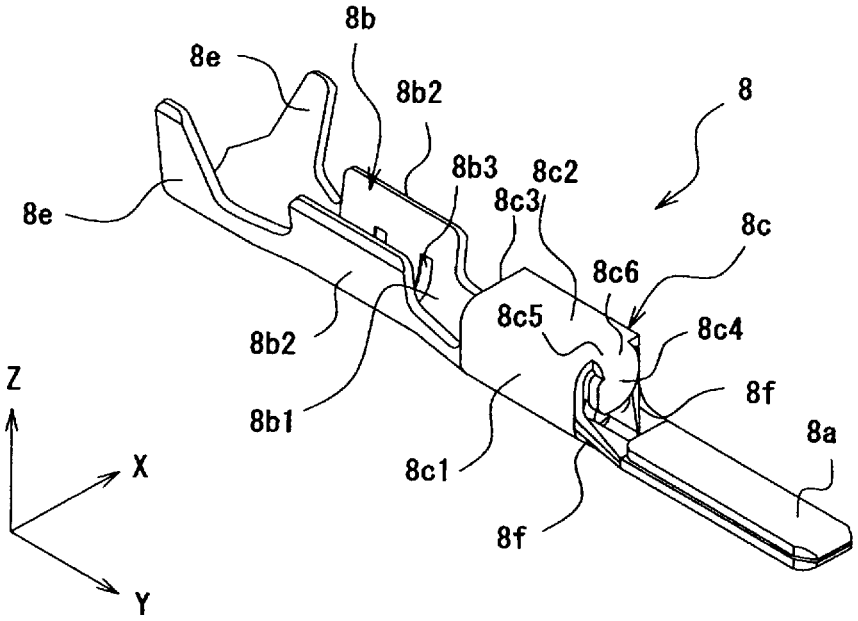
FIG. 15 is a perspective view illustrating a backside, the top side, and a left side of the socket terminal of FIG. 1.
Figure 16:
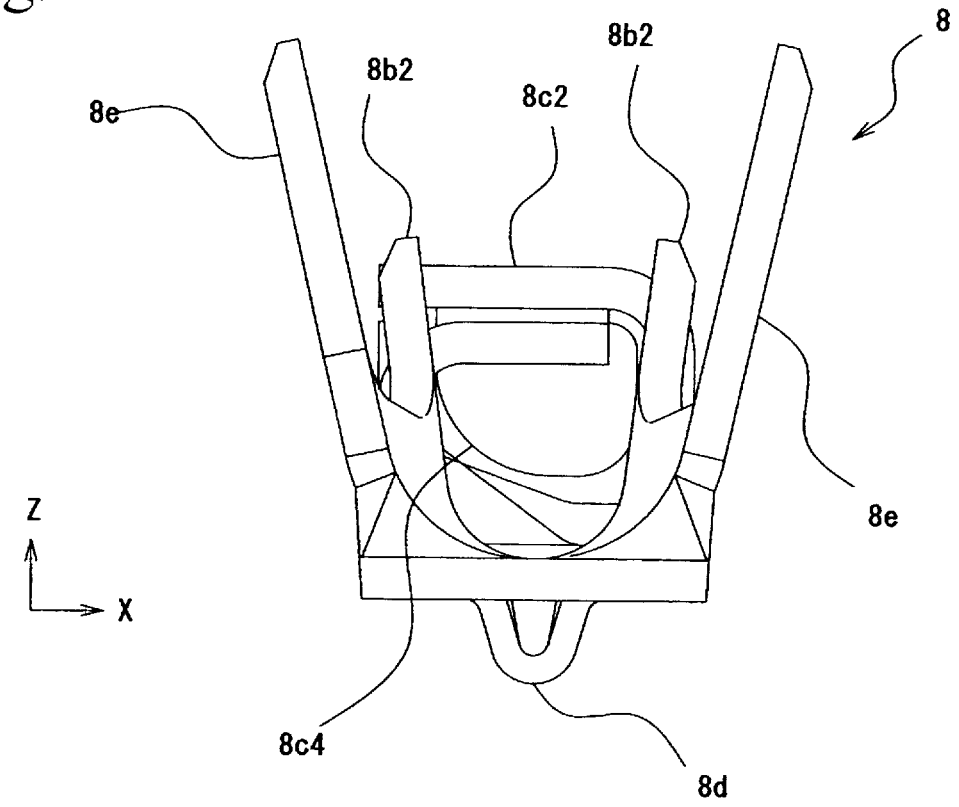
FIG. 16 is a front view of the socket terminal of FIG. 1.
Figure 17:
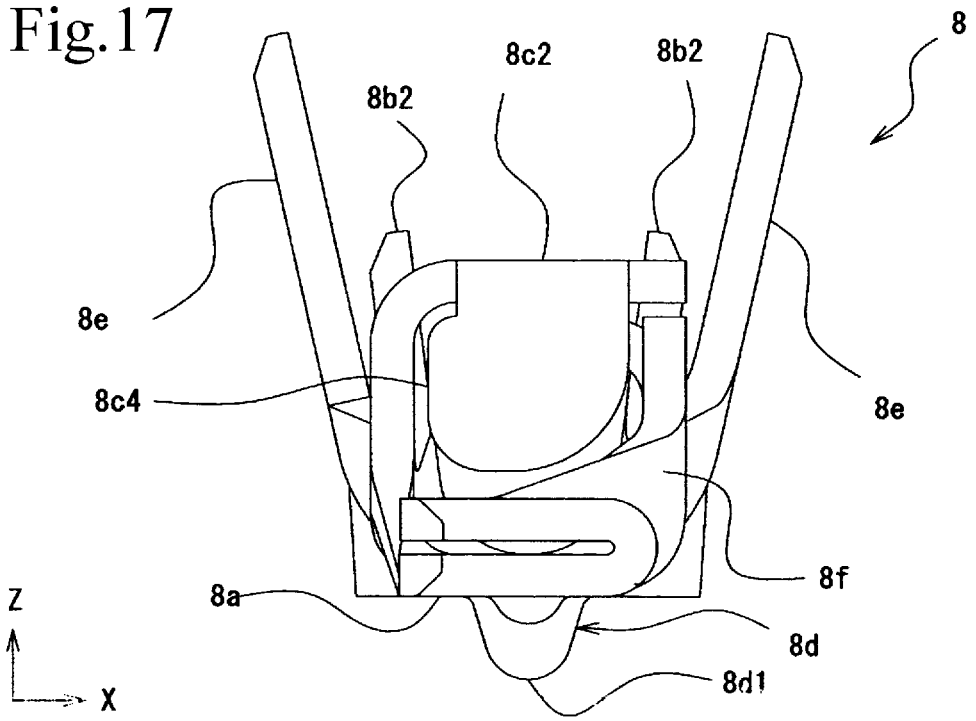
FIG. 17 is a rear view of the socket terminal of FIG. 1.
Figure 18:
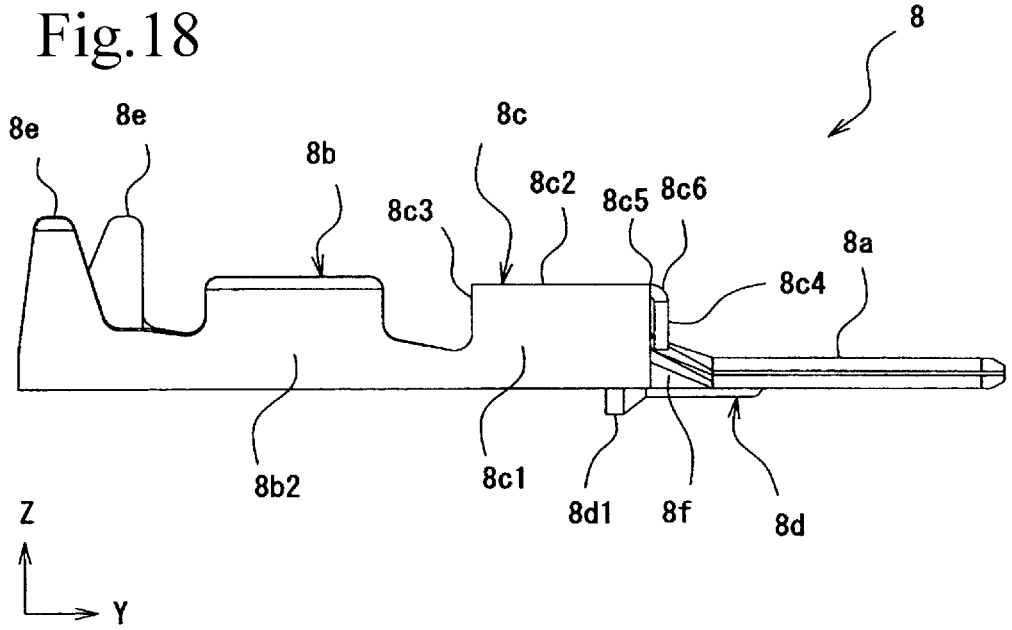
FIG. 18 is a right side view of the socket terminal of FIG. 1.
Figure 19:
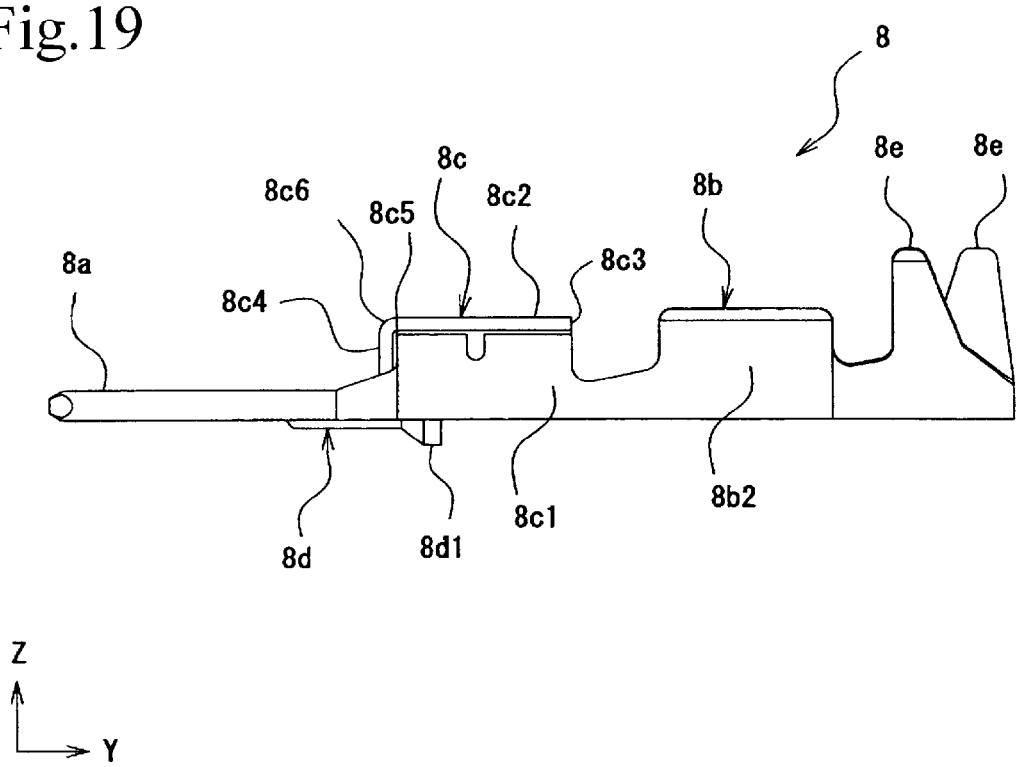
FIG. 19 is a left side view of the socket terminal of FIG. 1.
Figure 20:
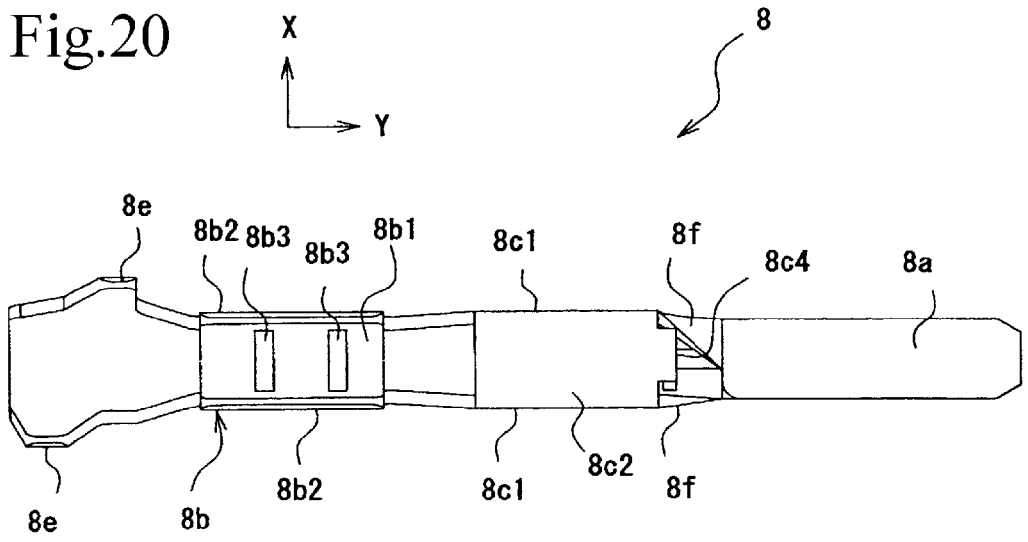
FIG. 20 is a plan view of the socket terminal of FIG. 1.
Figure 21:
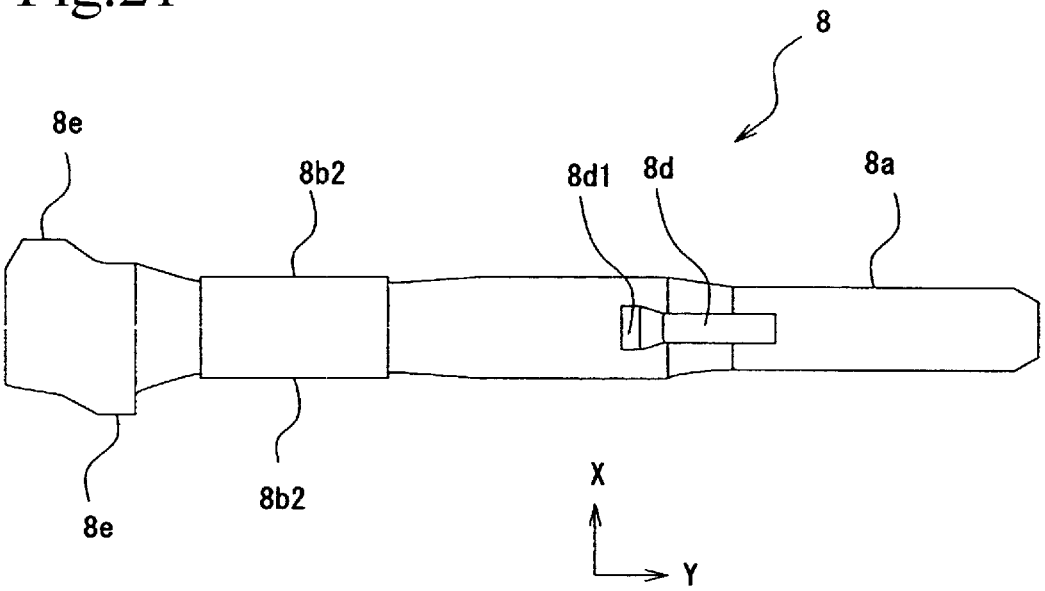
FIG. 21 is a rear view of the socket terminal of FIG. 1.

As illustrated in FIGS. 1 and 2, the connector 1 includes a plug connector 6 that includes a plug housing 4 and a plurality of plug terminals 5 and that is fixed to the circuit board 3, and a socket connector 9 that includes a socket housing 7, which fits into the plug housing 4, and a plurality of socket terminals 8 that are in conductive contact with the plug terminals 5.

Plug Connector

As illustrated in FIGS. 1 to 4, 7 to 13, and 25, the plug connector 6 includes the plug housing 4 that is formed of insulating resin and that has a substantially rectangular shape, and the plurality of plug terminals 5 each formed of a flat plate-shaped metal piece.

Plug Housing

As illustrated in FIGS. 1 to 4, 32, and 33, the plug housing 4 includes an upper wall 4*a*, a lower wall 4*b*, sidewalls 4*c* and 4*c*, and a back wall 4*d*, and is formed in a box shape in which a fitting port 4*e* is open at the front. The plug housing 4 includes therein an accommodation space 4*f* to which the socket connector 9 is fitted and is accommodated, terminal accommodation portions 4*g* that accommodate elastic contact pieces 5*a* of the plug terminals 5, and fixing grooves 4*h* and 4*h* that fix the plug terminals 5.

The accommodation space 4*f* is formed inside the plug housing 4. The fitting port 4*e* for inserting the socket connector 9 is provided on the opposite side with respect to the back wall 4*d* in which the plug terminals 5 are disposed in the width direction X in a parallel manner.

The terminal accommodation portions 4*g* are provided so as to protrude in the direction in which the elastic contact pieces 5*a* extend and from the back wall 4*d* towards the inside of the accommodation space 4*f*. The terminal accommodation portions 4*g* each include first wall portions 4*g*1 that are provided on the sides to which the elastic contact pieces 5*a* are displaced when pushed by the socket terminal 8, and second wall portions 4*g*2 that are provided so as to extend in the height direction Z from the plate edges of the first wall portions 4*g*1 extending in the front-rear direction Y such that the plate surfaces of the second wall portions 4*g*2 are orthogonal to the first wall portions 4*g*1.

Each of the terminal accommodation portions 4*g* forms a recess in cross-sectional view with a first wall portion 4*g*1 and a pair of second wall portions 4*g*2 and accommodates an elastic contact piece 5*a* therein. Since the second wall portions 4*g*2 cover the plate surfaces of the elastic contact piece 5*a*, the terminal accommodation portion 4*g* covers the elastic contact piece 5*a* from three directions except for the direction on the plate edge side in which a contact recess 5*b* described later is provided. With the above, adjacent plug terminals 5 can be insulated from each other.

A single plug terminal 5 includes two elastic contact pieces 5*a*, and the terminal accommodation portions 4*g* each accommodate a single elastic contact piece 5*a*. A plurality of sets, each set constituted by a single plug terminal 5 and two corresponding terminal accommodation portions 4*g*, are provided inside the accommodation space 4*f* of the plug housing 4 in the width direction X so as to coincide with the arrangement of the plug terminals 5. Furthermore, two upper and lower rows, each row constituted by the above sets of the terminal accommodation portions 4*g*, are provided in the plug housing 4, and the upper row and the lower row are formed so as to be offset with respect to each other by half a pitch in the width direction X. The first wall portions 4*g*1 on lower sides of the terminal accommodation portions 4*g* of the upper row and the first wall portions 4*g*1 on the upper sides of the terminal accommodation portions 4*g* of the lower row are provided on a straight line that extends in the width direction X and are connected to each other.

The fixing grooves 4*h* are formed in the back wall 4*d* of the plug housing 4 and are provided as grooves that extend in the front-rear direction Y from the outer side of the back wall 4*d* towards the inside. Furthermore, the fixing grooves 4*h* are used when fixing the plug terminals 5 to the plug housing 4.

In known and typical connectors, the plug terminals are formed in pin shapes, protrude to the outside from the back side positioned opposite the fitting ports at the front of the plug housing, and are bent towards the circuit board. The end portions of the plug terminals on the board side are soldered to the plated circuit. Conversely, the connector 1 includes groove portions 4*d*1 that extend in the height direction Z on the outer side of the back wall 4*d*, and base portions 5*c* of the plug terminals 5 are accommodated in the groove portions 4*d*1. With the above, the plug terminals 5 can be retained inside the thickness of the back wall 4*d* without protruding to the outside of the back wall 4*d* of the plug housing 4; accordingly, the size of the overall connector 1 in the front-rear direction Y can be reduced and the area occupied by the circuit board 3 can be reduced. Furthermore, by reducing the portions of the plug terminals 5 that are exposed to the outside through the plug housing 4, damage of the plug terminals 5 and foreign matter adhering to the plug terminals 5 can be reduced.

Plug Terminal

As illustrated in FIGS. 1 to 4, and 7 to 13, each plug terminal 5 is formed by punching a flat plate-shaped metal piece and is fixed to the plug housing 4 such that the plate surface extends in the height direction Z of the plug housing 4. Due to the flat plate shape with no bent portion in the plate thickness direction, the connector 1 may be a connector that is compact in the width direction X (in the arrangement direction of the plug terminals).

Each plug terminal 5 includes a fork-shaped terminal portion 5*d* that is in conductive contact with the corresponding socket terminal 8, the base portions 5*c* from which the fork-shaped terminal portion 5*d* extends, fixing pieces 5*e* that are fixed to the plug housing 4, and a board fixing piece 5*h* that is connected to the circuit board 3.

The fork-shaped terminal portion 5*d* includes a contact recess 5*b* that is formed by the fork-shaped terminal portion 5*d* being branched into two forks in the height direction Z, a pair of elastic contact pieces 5*a* that are provided as a "contact piece", and contact projections 5*f* that are in conductive contact with the corresponding socket terminal 8. Each fork-shaped terminal portion 5*d* penetrates through the back wall 4*d* of the plug housing 4 in the front-rear direction Y, and the elastic contact pieces 5*a* extend towards the inside of the accommodation space 4*f*.

The contact recess 5*b* is provided between the elastic contact pieces 5*a* and is formed by a recess-shaped plate edge that includes an opening 5*b*1 on a side in which the socket terminal 8 is inserted. Furthermore, the contact recess 5*b* is conductively in contact with a flat bar-like connection piece 8*a* of the socket terminal 8, which has been inserted through the opening 5*b*1, by holding the flat bar-like connection piece 8*a* in a direction extending along the plate surface of the plug terminal 5 (the up-down direction of the connector 1).

The elastic contact pieces 5*a* are capable of being displaced in the height direction Z that extends along the plate surface of the plug terminal 5, and the two elastic contact pieces 5*a* included in a single fork-shaped terminal portion 5*d* are provided in the height direction Z. The elastic contact pieces 5*a* are accommodated inside the accommodation space 4*f* and in the terminal accommodation portion 4*g* of the plug housing 4.

The contact projections 5*f* protrude in the directions in which the contact projections 5*f* come into contact with the flat bar-like connection piece 8*a* of the socket terminal 8 described later from the distal end side of the plug terminal 5. Particularly, when in a state in which the elastic contact pieces 5*a* are accommodated in the terminal accommodation portion 4*g*, the tips of the contact projections 5*f* protrude from the terminal accommodation portion 4*g* in the directions in which the contact projections 5*f* come into contact with the flat bar-like connection piece 8*a*. The plug terminal 5 is in conductive contact with the flat bar-like connection piece 8*a* by holding the flat bar-like connection piece 8*a* between the opposing contact projections 5*f* and 5*f*.

In the tips of the contact projections 5*f*, contact edges 5*g* that come into contact with the socket terminal 8 includes, from the front side (the rear side) towards the back side (the front side) in the insertion direction of the flat bar-like connection piece 8*a*, a front edge 5*g*1 and a rear edge 5*g*2 that have angles of inclination that are different from each other with respect to the line extending in the insertion direction. The rear edge 5*g*2 is continuously provided on the rear side (the tip side of the elastic contact piece 5*a*) with respect to the front edge 5*g*1, and the flat bar-like connection piece 8*a* comes into contact with the rear edge 5*g*2 before coming in contact with the front edge 5*g*1. Furthermore, the inclined surface of the front edge 5*g*1 is formed such that the angle of inclination thereof is smaller than the angle of inclination of the inclined surface of the rear edge 5*g*2. With the above, the flat bar-like connection piece 8*a* can be inserted smoothly.

Each base portion 5*c* extends in the height direction Z and is accommodated in the corresponding groove portion 4*d*1 of the plug housing 4.

The fork-shaped terminal portion 5*d* extends from the substantially middle position of the base portion 5*c* in the height direction Z. Furthermore, the pair of fixing pieces 5*e* are provided on the upper and lower sides of the fork-shaped terminal portion 5*d*.

The fixing pieces 5*e* extend in parallel with respect to the fork-shaped terminal portion 5*d*, and a protrusion 5*e*1 that protrudes towards the fork-shaped terminal portion 5*d* is provided on the plate edge of each of the fixing pieces 5*e*. By press fitting the fixing pieces 5*e* one by one into the fixing grooves 4*h* of the plug housing 4, each of the protrusions 5*e*1 is jammed into the inner wall of the corresponding fixing groove 4*h* such that the plug terminals 5 are fixed to the plug housing 4. By forming the fixing pieces 5*e* on the upper and lower sides of the fork-shaped terminal portion 5*d*, even if the elastic contact pieces 5*a* are displaced in the height direction Z, the fork-shaped terminal portion 5*d* can be reliably fixed to the plug housing 4. Furthermore, by forming the fixing pieces 5*e* so that the fixing pieces 5*e* extend from the base portion 5*c*, from which the fork-shaped terminal portion 5*d* extends, in the same direction and in parallel with respect to the fork-shaped terminal portion 5*d* at different positions in height, the size of the plug housing 4 in the front-rear direction Y can be reduced. Furthermore, compared with a case in which the fixing pieces 5*e* are provided on the left and right sides of the fork-shaped terminal portion 5*d* (on both sides of the fork-shaped terminal portion 5*d* in the width direction X), for example, the size of the overall connector 1 in the width direction X can be reduced.

The board fixing piece 5*h* is connected to the lower end side of the base portion 5*c* and extends in the front-rear direction Y and towards the side opposite to the side on which the fork-shaped terminal portion 5*d* and the fixing pieces 5*e* are provided. By soldering the board fixing piece 5*h* to the circuit board 3, the plug terminal 5 is fixed to the circuit board 3.

The plug connector 6 includes two types of plug terminals 5 that have different heights and in which the heights where the fork-shaped terminal portions 5*d* are provided are different. Compared with plug terminals 10*a* with a short height, plug terminals 10*b* with a tall height have longer base portions 5*c*. The plug terminals 10*b* with a tall height are in conductive contact with the socket terminals 8 of the upper row described later. Conversely, the plug terminals 10*a* with a short height are in conductive contact with the socket terminals 8 of the lower row described later. The plug terminal 10*b* with a tall height and the plug terminal 10*a* with a short height are alternately disposed in the width direction X. With the above, while having a small pitch, occurrence of short-circuiting can be prevented by setting adjacent fork-shaped terminal portions 5*d* away from each other at a distance.

Socket Connector

As illustrated in FIGS. 1, 2, 5, 6, and 14 to 24, the socket connector 9 includes a socket housing 7 that fits into the plug housing 4, and the plurality of socket terminals 8 that are in conductive contact with the plug terminals 5.

Socket Housing

As illustrated in FIGS. 1, 2, 5, 6, 22, and 23, the socket housing 7 includes a socket housing body 11 and a retainer 12 that fixes the socket terminals 8 to the socket housing body 11.

Figure 32:
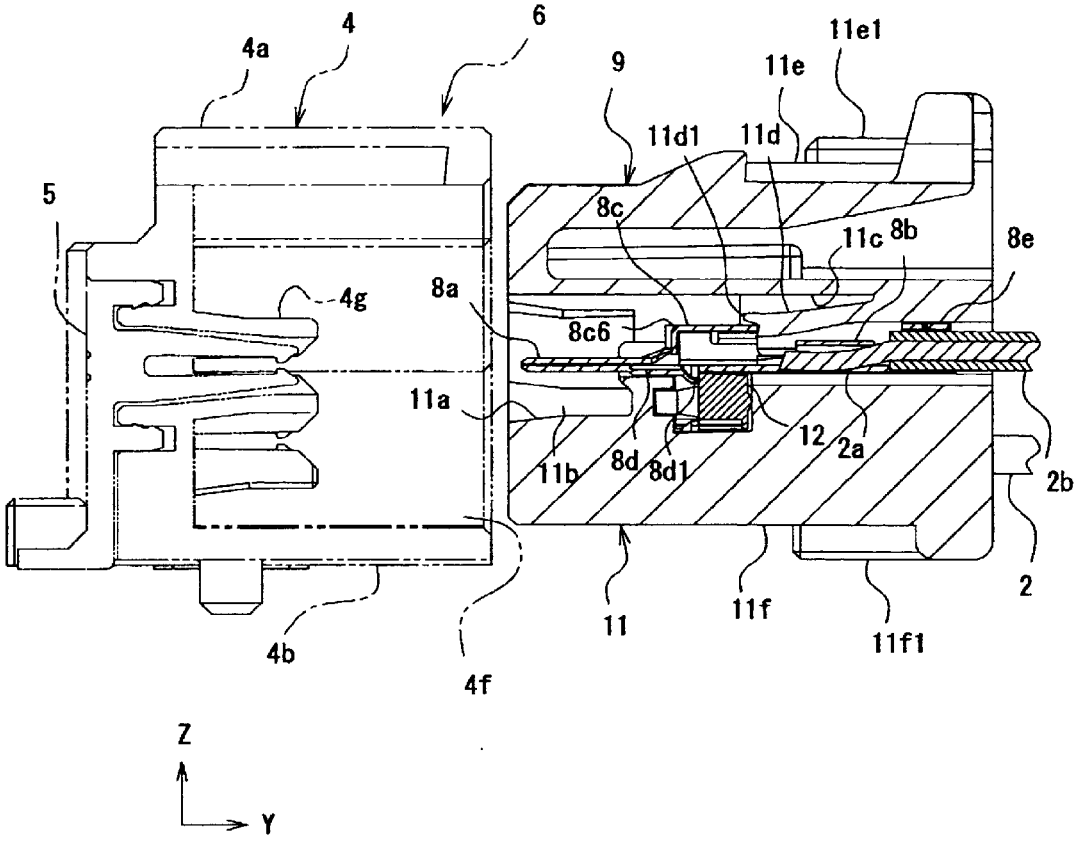
FIG. 32 is a cross-sectional view illustrating the socket connector of FIG. 1.
Figure 33:
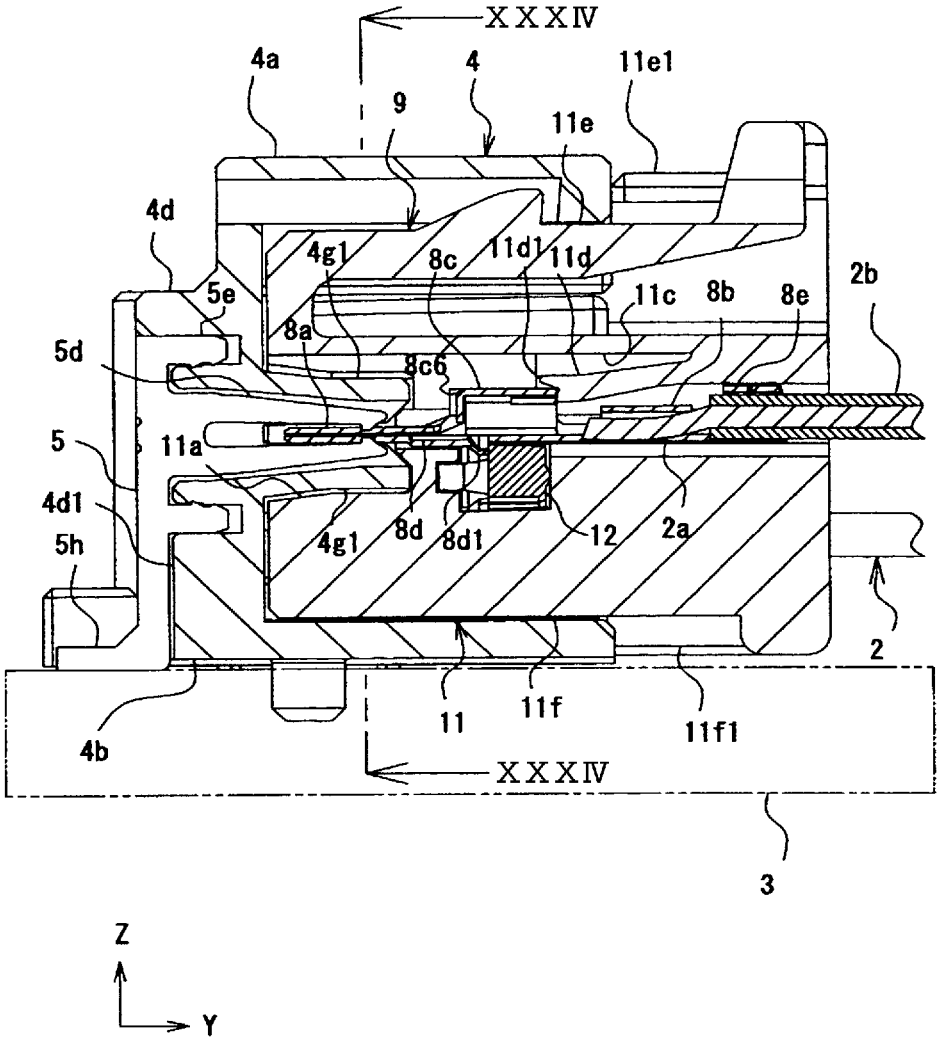
FIG. 33 is a cross-sectional view illustrating a fixed state of the plug connector and the socket connector of FIG. 1.

The socket housing body 11 is formed of insulating resin in a substantially rectangular shape. As illustrated in FIGS. 32 and 33, the socket housing body 11 includes a plurality of accommodation recesses 11*a* into which the socket terminals 8 are inserted and that are arranged in parallel in the width direction X, interpolar walls 11*b* that are provided between adjacent accommodation recesses 11*a*, terminal mounting holes 11*c* that are in communication with the accommodation recesses 11*a*, housing lances 11*d* that fix the socket terminals 8 to the socket housing 7, surface contact portions 11*e*1 that are provided on upper surface 11*e* of the socket housing body 11, and surface contact portions 11*f*1 that are provided on the underside 11*f*.

The accommodation recesses 11*a* are provided in the socket housing body 11 on the front side with respect to the direction in which the accommodation recesses 11*a* is inserted into the plug housing 4. Two upper and lower rows of the accommodation recesses 11*a* are provided in the socket housing 7 in which the upper row is constituted by substantially inverted U-shaped recesses and the lower row is constituted by substantially U-shaped recesses. Furthermore, the accommodation recesses 11*a* of the upper row and those of the lower row are formed so as to be offset with respect to each other by half a pitch in the width direction X. While in a state in which the socket terminals 8 are fixed to the socket housing 7, the flat bar-like connection pieces 8*a* are accommodated in the accommodation recesses 11*a*.

In a state in which the socket housing 7 and the plug housing 4 are fitted together, the flat bar-like connection pieces 8*a* and the two elastic contact pieces 5*a* included in each of the plug terminals 5 are in conductive contact with each other inside the accommodation recesses 11*a*. In the above state, the accommodation recesses 11*a* accommodate the elastic contact pieces 5*a* and the adjacent second wall portions 4*g*2. Furthermore, in the plug terminals 5 of the upper row, in addition to the second wall portions 4*g*2, the first wall portions 4*g*1 adjacent to the elastic contact pieces 5*a* on the upper side are also accommodated in the accommodation recesses 11*a*. Conversely, in the plug terminals 5 of the lower row, the first wall portions 4*g*1 adjacent to not the elastic contact pieces 5*a* on the upper side but to the elastic contact pieces 5*a* on the lower side are accommodated in the accommodation recesses 11*a*.

The interpolar walls 11*b* are provided between the accommodation recesses 11*a* and, in a state in which the socket housing 7 and the plug housing 4 are fitted together, the interpolar walls 11*b* are inserted between adjacent plug terminals 5 such that the adjacent plug terminals 5 can be divided from each other.

Each of the terminal mounting holes 11*c* are in communication with the corresponding accommodation recess 11*a*, and the terminal mounting holes 11*c* are arranged in parallel in the width direction X and in a plurality of rows. Furthermore, similar to the accommodation recesses 11*a*, two upper and lower rows are provided in the socket housing 7, and the upper row and the lower row are formed so as to be offset with respect to each other by half a pitch in the width direction X.

A tab portion 8*c* and a caulking portion 8*b* of each of the socket terminals 8 are inserted into the corresponding terminal mounting hole 11*c*. The inner groove structure of the accommodation recesses 11*a* of the upper row and that of the lower row are formed so as to be vertically inverted with respect to each other, and the socket terminals 8 that are inserted into the terminal mounting holes 11*c* are also inserted in a vertically inverted state.

The housing lances 11*d* are provided in the terminal mounting holes 11*c* and, as illustrated in FIGS. 32 and 33, in the upper row, each of the housing lances 11*d* extends downwards and frontwards in the insertion direction of the socket terminal 8 from a wall on the upper side such that the housing lance 11*d* is provided so as to extend into the terminal mounting hole 11*c* in a cantilevered state. Furthermore, in the lower row, the housing lances 11*d* are provided in a vertically inverted manner with respect to the upper row such that each of the housing lances 11*d* extends upwards and forwards in the insertion direction of the socket terminal 8 from a wall on the lower side such that the housing lance 11*d* is provided so as to extend into the terminal mounting hole 11*c* in a cantilevered state. A free end of each housing lance 11*d* being branched into two in the height direction Z includes a branched portion 11*d*1. The branched portion 11*d*1 is locked to the tab portion 8*c* of the socket terminal 8.

Figure 22:
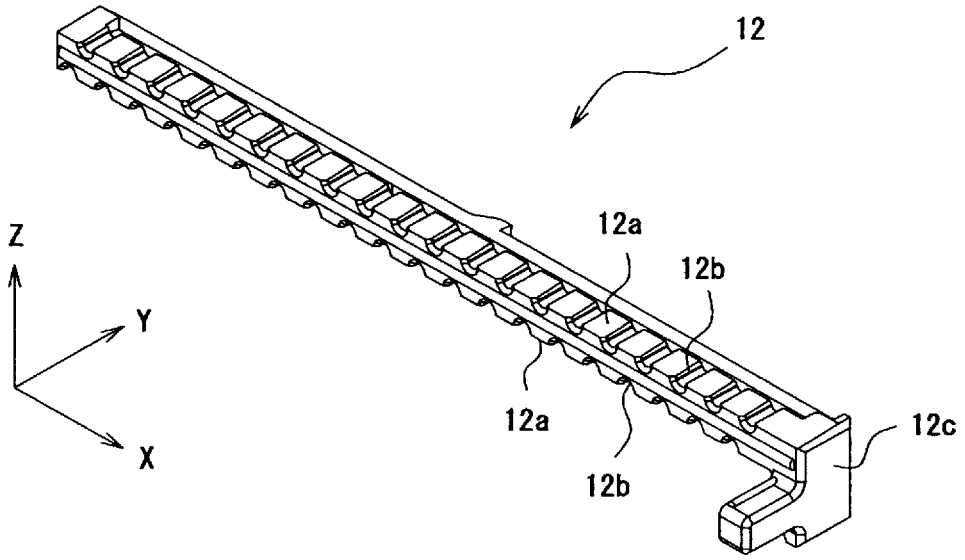
FIG. 22 is a perspective view illustrating a front side, a top side, and a right side of a retainer of FIG. 1.
Figure 23:
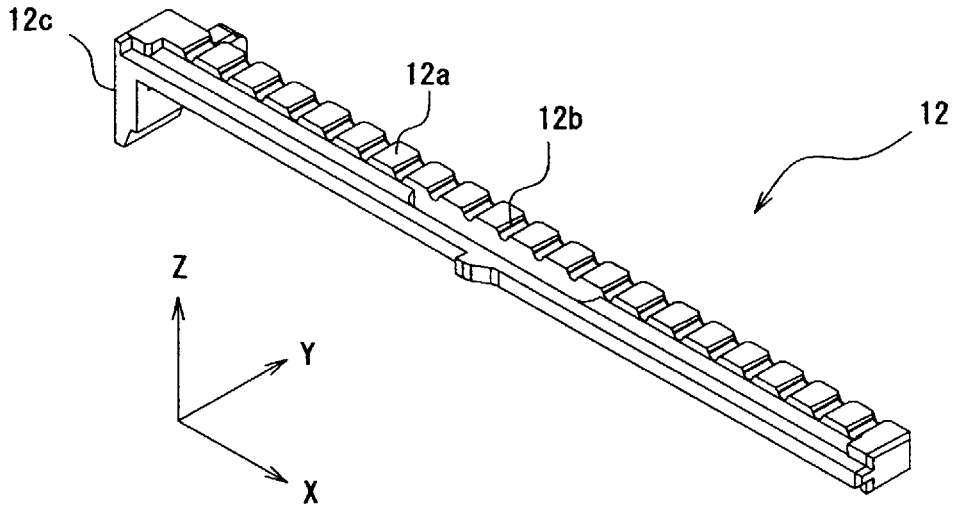
FIG. 23 is a perspective view illustrating a backside, the top side, and a left side of the retainer of FIG. 1.
Figure 24:
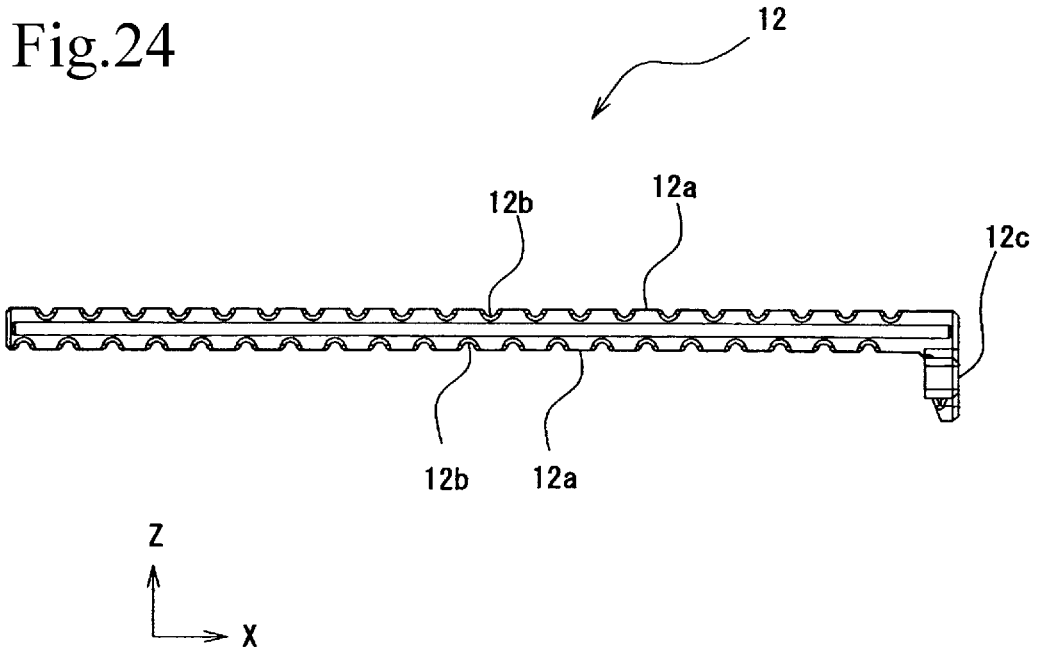
FIG. 24 is a front view of the retainer of FIG. 1.
Figure 25:
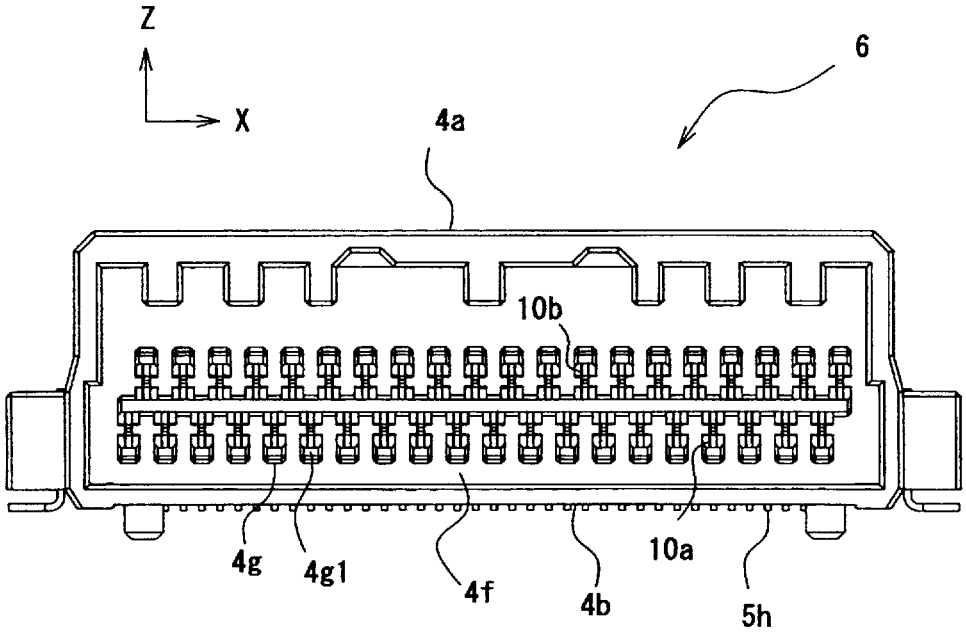
FIG. 25 is a rear view of a plug housing of FIG. 1.
Figure 26:
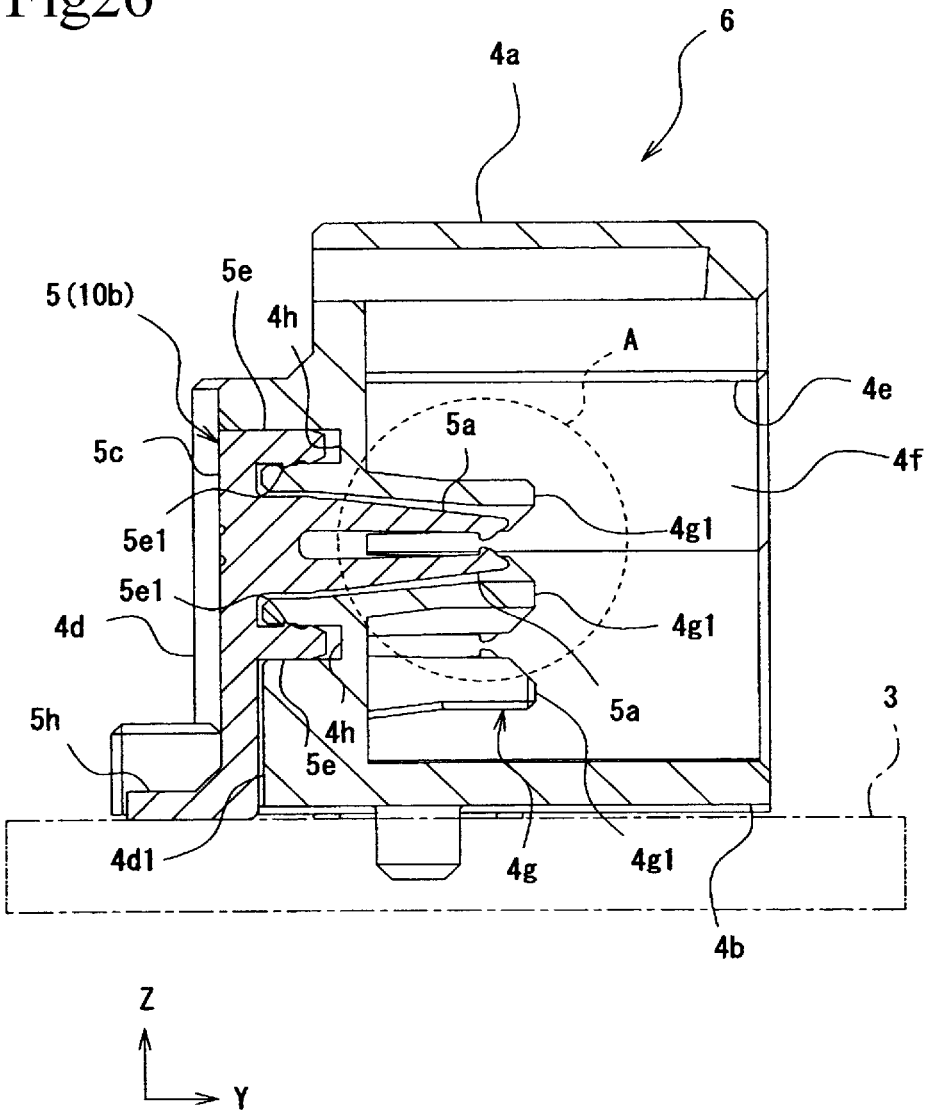
FIG. 26 is a cross-sectional view of the plug housing of FIG. 1.
Figure 27:
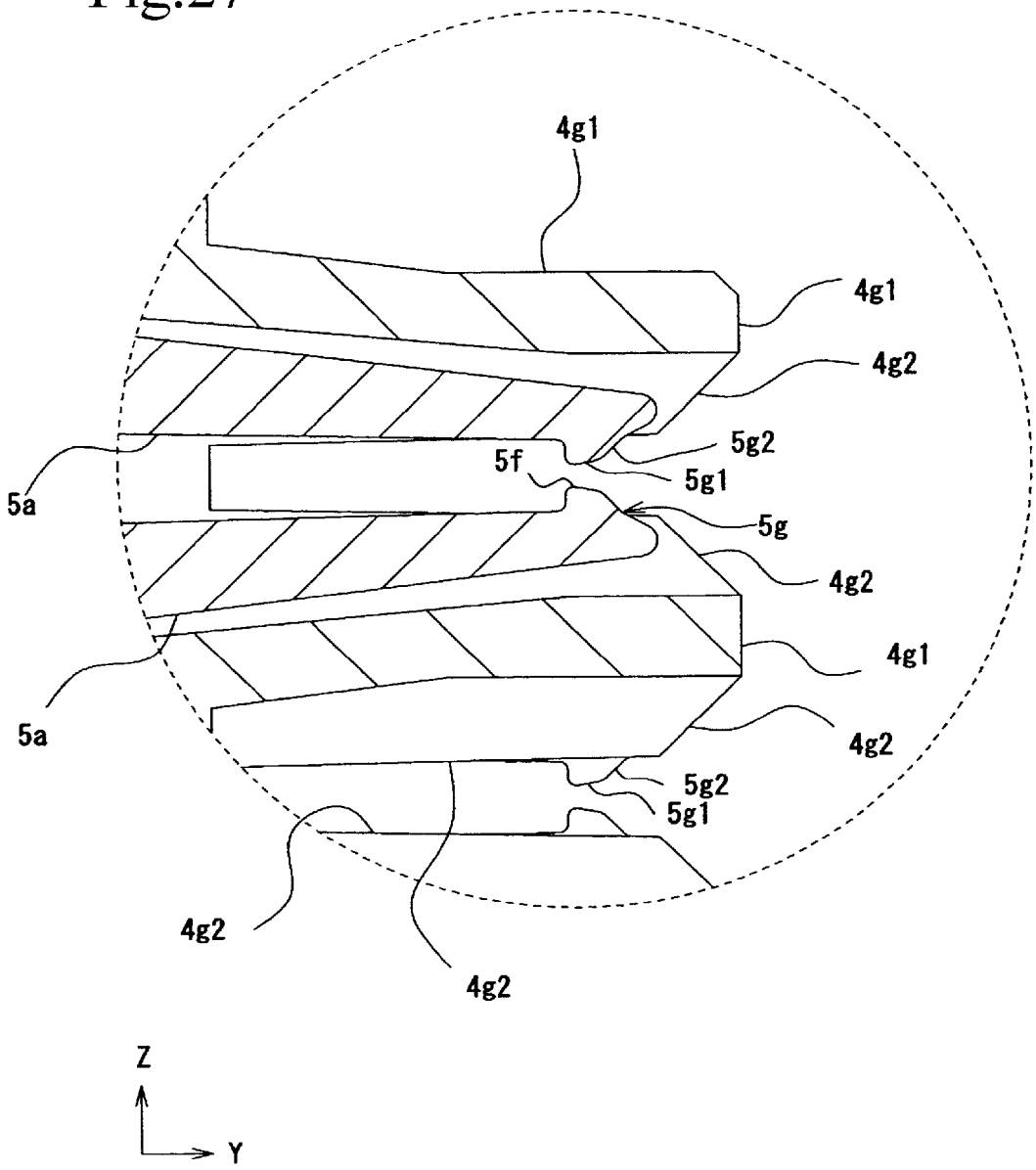
FIG. 27 is an enlarged view of portion A of the plug housing of FIG. 26.
Figure 28:
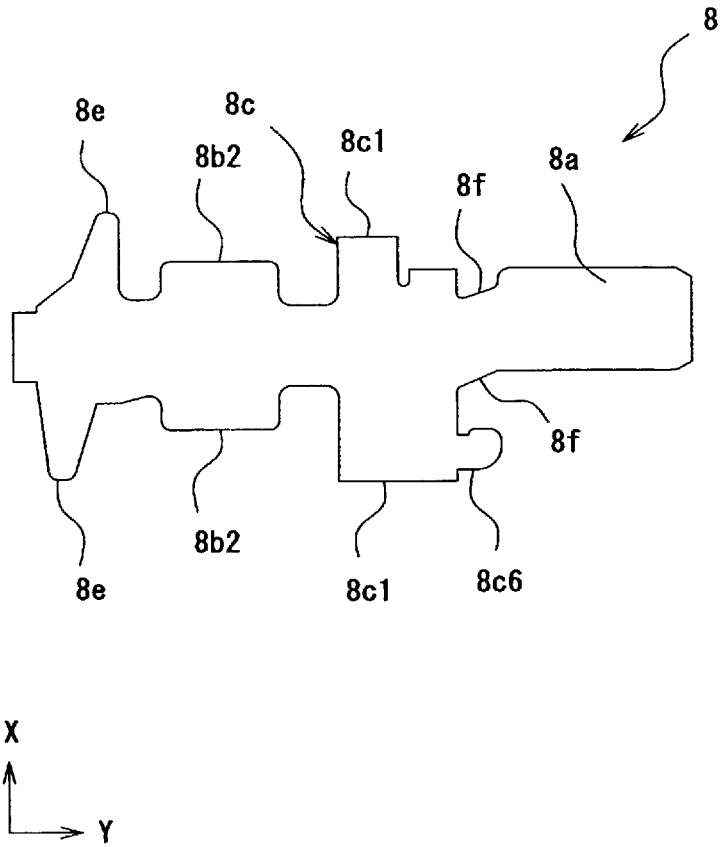
FIG. 28 is a development of the socket terminal of FIG. 1.

The retainer 12 is formed of insulating resin and, as illustrated in FIGS. 22 to 24, is provided in a substantially rectangular parallelepiped shape that extends longitudinally in the width direction X of the socket housing body 11. The retainer 12 is inserted in the socket housing body 11 in the width direction X and between the terminal mounting holes 11*c* of the upper row and the terminal mounting holes 11*c* of the lower row. The upper surface side of the retainer 12 is exposed inside the terminal mounting holes 11*c* of the upper row, and the lower surface side thereof is exposed inside the terminal mounting holes 11*c* of the lower row.

A plurality of lock portions 12*a* that have flat surfaces and a plurality of insertion recesses 12*b* that have arc-shaped cross-sections and that are alternatively arranged with the lock portions 12*a* are provided in the width direction X on the upper surface side and the lower surface side of the retainer 12. Bead portions 8*d* of the socket terminals 8 can be passed through the insertion recesses 12*b* while in a state in which the insertion of the retainer 12 into the socket housing body 11 has not been completed (in a temporarily fixed state). After passing the bead portions 8*d* through the insertion recesses 12*b* as above, by pushing the retainer 12 into the socket housing body 11 (a locked state) by moving the retainer 12 in the width direction X with respect to the socket housing body 11 from the temporarily fixed state, the lock portions 12*a* can be disposed at a lock position with respect to the bead portions 8*d*.

Similar to the accommodation recesses 11*a* of the socket housing body 11, the insertion recesses 12*b* of the upper surface side and those of the lower surface side are formed so as to be offset with respect to each other by half a pitch in the width direction X. An operation portion 12*c* for performing an operation of shifting the retainer 12 in the width direction X is provided on one end side of the retainer 12 in the width direction X.

Two surface contact portions 11*e*1 are provided so as to protrude towards the upper side from the upper surface 11*e* of the socket housing body 11. Conversely, two surface contact portions 11*f*1 are provided so as to protrude towards the lower side from the underside 11*f* of the socket housing body 11.

Socket Terminal

The socket terminals 8 are each provided by bending a flat plate-shaped metal piece. Furthermore, as illustrated in FIGS. 14 to 21 and 28, each socket terminal 8 includes the flat bar-like connection piece 8*a* that comes in conductive contact with the plug terminal 5, the tab portion 8*c* that is locked to the housing lance 11*d* described above, the caulking portion 8*b* that is in conductive contact with a copper wire 2*a* of the linear conductor 2, clamps 8*e* that fix a coating 2*b* of the linear conductor 2, and the bead portion 8*d* provided on the lower surface side of the socket terminal 8.

The flat bar-like connection piece 8*a* is provided on the front side of the socket terminal 8 in the direction in which the socket terminal 8 is inserted into the socket housing 7. When the plug housing 4 and the socket housing 7 are fitted together, the flat bar-like connection piece 8*a* is inserted into the contact recess 5*b* of the plug terminal 5 while pushing through and widening the portion between the opposing contact projections 5*f* and 5*f* so as to be in conductive contact with the contact projections 5*f* and 5*f*.

The flat bar-like connection piece 8*a* is a double metal piece formed by folding back a metal piece along the width direction X. By increasing the thickness in the above manner, since the flat bar-like connection piece 8*a* can be reinforced, the flat bar-like connection piece 8*a* can be made to not easily deform itself when receiving load when coming into contact with the contact projections 5*f* of the plug terminal 5. Furthermore, by increasing the thickness as above, even if the interval between the opposing two contact projections 5*f* and 5*f* of the plug terminal 5 is formed large, when the flat bar-like connection piece 8*a* is inserted between the contact projections 5*f* and 5*f*, the flat bar-like connection piece 8*a* can easily be in conductive contact with the two contact projections 5*f* and 5*f*.

The tab portion 8*c* is provided adjacent to the proximal end side of the flat bar-like connection piece 8*a*. As illustrated in FIGS. 14 to 17, the tab portion 8*c* is formed into a hollow, substantially square cylindrical shape by bending a flat plate-shaped metal piece to form two sidewalls 8*c*1 and 8*c*1 and an upper surface portion 8*c*2. The sidewalls 8*c*1 and 8*c*1 are provided so as to extend in the height direction Z from the plate edges of the socket terminal 8 extending in the front-rear direction Y. The upper surface portion 8*c*2 is provided by bending the end portions of the sidewalls 8*c*1 and 8*c*1 in the width direction X each towards its opposing sidewall 8*c*1 side such that two metal pieces are stacked.

As illustrated in FIGS. 18, 19, 32, and 33, the housing lance 11*d* described above is locked to a rear end portion 8*c*3 of the upper surface portion 8*c*2 in the insertion direction. By stacking the metal piece in two layers, the upper surface portion 8*c*2 can be reinforced; accordingly, even if the housing lance

11*d* is locked to the thin metal pieces, the metal pieces can be made to not easily deform itself.

The metal piece extends from the end portion of the upper surface portion 8*c*2 on the front side in the insertion direction and is bent towards the lower side such that a protection wall 8*c*4 is provided so as to put a lid on the opening of the substantially square cylindrical tab portion 8*c*. Furthermore, the plate edge of the end portion of the protection wall 8*c*4 is chamfered and is formed with a round shape.

As described above, since in the flat bar-like connection piece 8*a*, metal pieces are stacked in two layers as described above, the flat bar-like connection piece 8*a* has a structure that is not easily deformed even if a load is applied when coming into contact with the elastic contact pieces 5*a* of the plug terminal 5. Furthermore, the tab portion 8*c* has a substantially square cylindrical shape and is made to not easily deform itself even if a pulling load is applied when the housing lances 11*d* is locked thereto. However, the portion between the flat bar-like connection piece 8*a* and the tab portion 8*c* is a metal piece of a single layer and, accordingly, is easily deformed when a load is applied when coming into contact with the plug terminal 5.

Accordingly, reinforcement portions 8*f* and 8*f* are provided in the portion between the flat bar-like connection piece 8*a* and the tab portion 8*c* on the two plate edges of the socket terminal 8 extending in the front-rear direction Y. Each of the reinforcement portions 8*f* is formed so as to extend from the lower side of the sidewall 8*c*1 of the tab portion 8*c* towards the flat bar-like connection piece 8*a* side. By providing the reinforcement portions 8*f*, the strength between the flat bar-like connection piece 8*a* and the tab portion 8*c* can be increased such that deformation does not easily occur.

The caulking portion 8*b* is provided adjacent to the tab portion 8*c* and includes a bottom portion 8*b*1 that is provided in the extending direction of the linear conductor 2, and projections 8*b*2 that push the copper wire 2*a* against the bottom portion 8*b*1. In the bottom portion 8*b*1, a plurality of recesses 8*b*3 each having a substantially rectangular shape that extends in the width direction X are provided. Furthermore, a single projection 8*b*2 projects from each of the plate edges on both sides of the bottom portion 8*b*1 extending in the front-rear direction Y such that the projections 8*b*2 oppose each other. The projections 8*b*2 that are bent press the copper wire 2*a* of the linear conductor 2 against the bottom portion 8*b*1; accordingly, the linear conductor 2 is fixed to the socket terminal 8. Furthermore, the linear conductor 2 is pressed against the recesses 8*b*3 provided in the bottom portion 8*b*1; accordingly, the copper wire 2*a* and the socket terminal 8 become conductively connected to each other in a reliable manner. Furthermore, the oxide layer of the copper wire 2*a* can be broken with the edge portion of the recesses 8*b*3.

A single clamp 8*e* is provided so as to project from each of the plate edges on both sides of the bottom portion 8*b*1 extending in the front-rear direction Y. The clamps 8*e* are formed so as to be at an offset position with respect each other in the front-rear direction Y so as not to oppose each other. The two clamps 8*e* are bent so as to be wrapped around and in press-contact with the coating 2*b* of the linear conductor 2; accordingly, the socket terminal 8 is fixed with respect to the linear conductor 2.

The bead portion 8*d* is provided across the flat bar-like connection piece 8*a* and tab portion 8*c* and on the surface of the socket terminal 8 on the side opposite to the side in which the linear conductor 2 is fixed. As described above, the portion between the flat bar-like connection piece 8*a* and the tab portion 8*c* is weak and is easily deformed; accordingly, by providing the bead portion 8*d*, the above portion can be reinforced.

Furthermore, the bead portion 8*d* includes a lock portion 8*d*1 that is provided in a protruding manner. The lock portion 12*a* of the retainer 12 is locked to the lock portion 8*d*1.

Method of Fixing Linear Conductor to Socket Terminal

Figure 29:
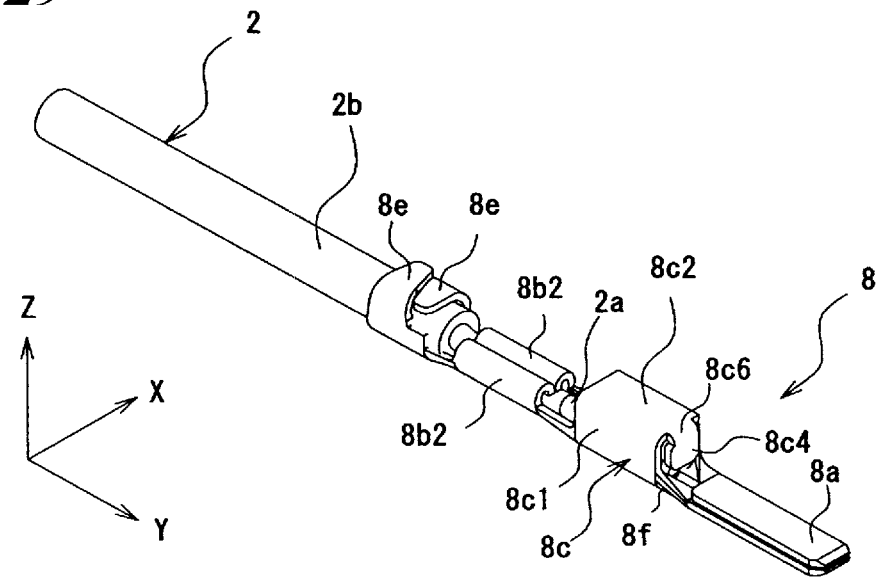
FIG. 29 is a perspective view of a linear conductor and the socket terminal of FIG. 1.
Figure 30:
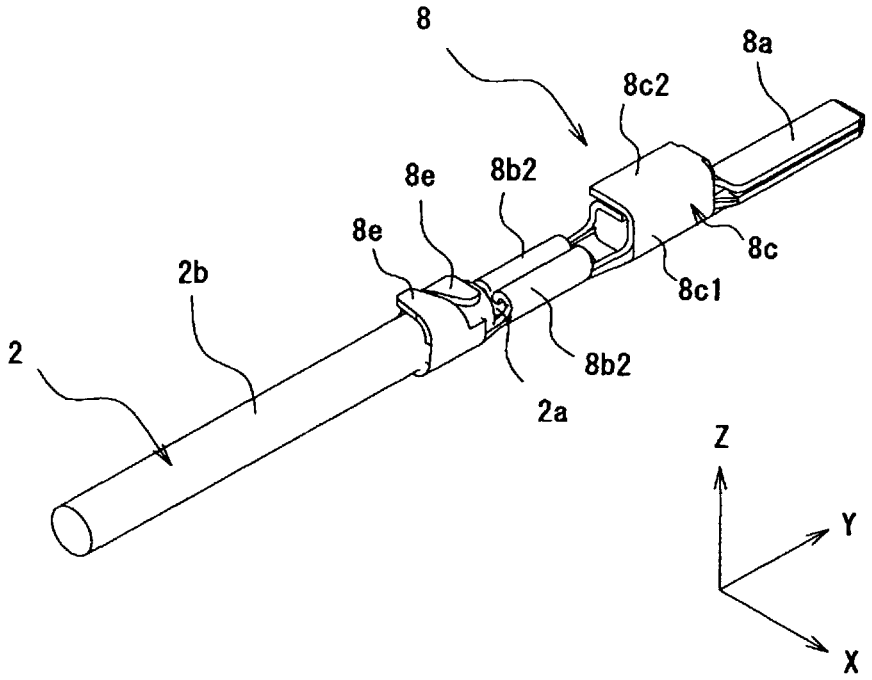
FIG. 30 is a perspective view of the linear conductor and the socket terminal of FIG. 1.

The socket terminal 8 is fixed to the distal end side of the linear conductor 2. Specifically, as illustrated in FIGS. 29 and 30, the linear conductor 2 is fixed by pressing the clamps 8*e* of the socket terminals 8 against the coating 2*b* on the distal end side of the linear conductor 2 so as to wind the clamps 8*e* around the coating 2*b*. Subsequently, the projections 8*b*2 of the caulking portion 8*b* are bent such that the copper wire of the linear conductor 2 is pressed against the bottom portion 8*b*1.

Method of Fixing the Socket Terminal to Socket Housing

Figure 31A:
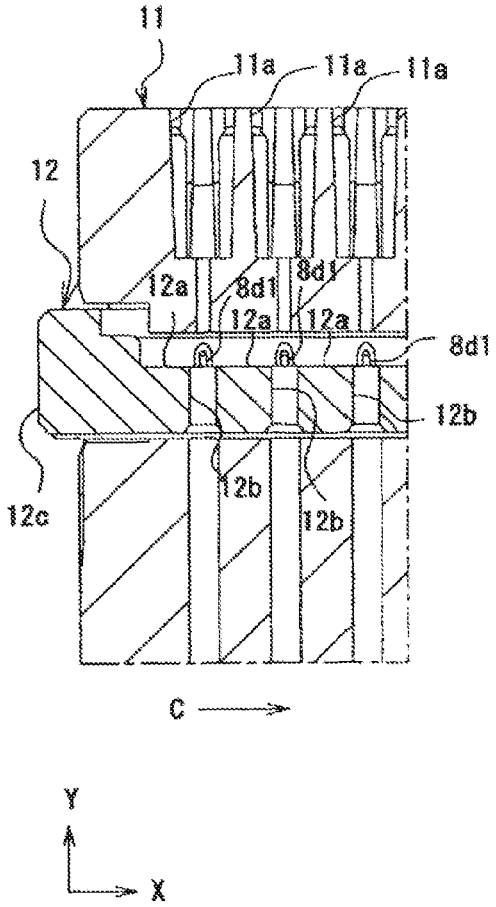

The retainer 12 is first slid in the width direction X and in the arrow C direction with respect to the socket housing 7 so as to be tuned into the temporarily fixed state from the locked state (see FIG. 31A).

Subsequently, the socket terminals 8 that are fixed to the linear conductors 2 as described above are inserted into the terminal mounting holes 11*c* of the socket housing 7. When the socket terminals 8 are inserted into the terminal mounting holes 11*c* of the upper row, the bead portions 8*d* of the socket terminals 8 are oriented to the lower side. When the socket terminals 8 are inserted into the terminal mounting holes 11*c* of the lower row, the bead portions 8*d* are, conversely, oriented to the upper side. As described above, when the socket terminals 8 are inserted into the terminal mounting holes 11*c* while the bead portions 8*d* are oriented in a regular direction, the lock portions 8*d*1 of the bead portions 8*d* pass through the insertion recesses 12*b* of the retainer 12 and are inserted into the terminal mounting holes 11*c*. Conversely, when, supposedly, the lock portions 8*d*1 of the bead portions 8*d* are inserted into the terminal mounting holes 11*c* in a direction that is different from the regular direction, the lock portions 8*d*1 will be caught by the socket housing body 11 and the retainer 12 and will not be able to be inserted deep into the terminal mounting holes 11*c*; accordingly, the operator can recognize that the insertion direction is wrong.

When the socket terminals 8 is inserted into the terminal mounting holes 11*c*, front end portions 8*c*5 of the upper surface portions 8*c*2 of the tab portions 8*c* of the socket terminals 8 come into contact with the housing lances 11*d*. The housing lances 11*d* are provided so as to extend in a cantilevered state from the walls of the terminal mounting holes 11*c* so as to be capable of being elastically displaced. Accordingly, by further inserting the socket terminals 8 deep into the terminal mounting holes 11*c*, the upper surface portions 8*c*2 are pushed, bent (displaced), and are moved over the housing lances 11*d*. In such a case, the flat bar-like connection pieces 8*a* of the socket terminals 8 are accommodated inside the accommodation recesses 11*a* of the socket housing 7.

Supposedly, in the above state, when the socket terminals 8 and the linear conductors 2 are pulled in a direction that releases the socket terminals 8 and the linear conductors 2 from the terminal mounting holes 11*c*, the upper surface portions 8*c*2 become locked to the branched portions 11*d*1 that are each branched into two and that are provided at the tips of the housing lances 11*d* such that the socket terminals 8 and the linear conductors 2 are retained. Incidentally, the metal piece constituting the upper surface portion 8*c*2 is formed by bending the end portions of the two sidewalls 8*c*1 and 8*c*1. With the above, a structure that is not easily deformed is obtained, since the sidewalls 8*c*1 restrict the two metal pieces from moving even if a load in the up-down direction is applied to the upper surface portion 8c2 from the housing lance 11d.

As described above, the protection wall 8c4 that is bent and extends from the upper surface portion 8c2 is provided between the two sidewalls 8c1. A smooth bend portion 8c6 is formed between the protection wall 8c4 and the upper surface portion 8c2, and when the socket terminal 8 is inserted through the terminal mounting hole 11c, the bend portion 8c6 comes into slide contact with the housing lance 11d. Accordingly, compared to being in slide contact with a fractured surface, the surface of the housing lance 11d is less likely to be shaved off; accordingly, insertion property of the socket terminal 8 with respect to the terminal mounting hole 11c can be improved. Furthermore, at the same time, a situation such as the plate edge of the upper surface portion 8c2 coming into contact with the housing lance 11d shaving and damaging the housing lance 11d will less likely occur.

Furthermore, even if a force that deforms and bends the socket terminal 8 at a portion between the tab portion 8c and the flat bar-like connection piece 8a should act on the socket terminal 8, since the protection wall 8c4 will come into contact with and support the portion that is about to be bent, deformation and bending can be prevented. Furthermore, by chamfering the plate edge of the protection wall 8c4 into a round shape, a situation in which damage is caused by the deformed portion of the socket terminal 8 coming in contact with the edge portion will less likely occur.

Similar to the above, the socket terminals 8 that are fixed to the linear conductors 2 are inserted into all of the terminal mounting holes 11c in a one-to-one manner, and the lock portions 8d1 of the bead portions 8d are passed through the insertion recesses 12b of the retainer 12.

Figure 31B:
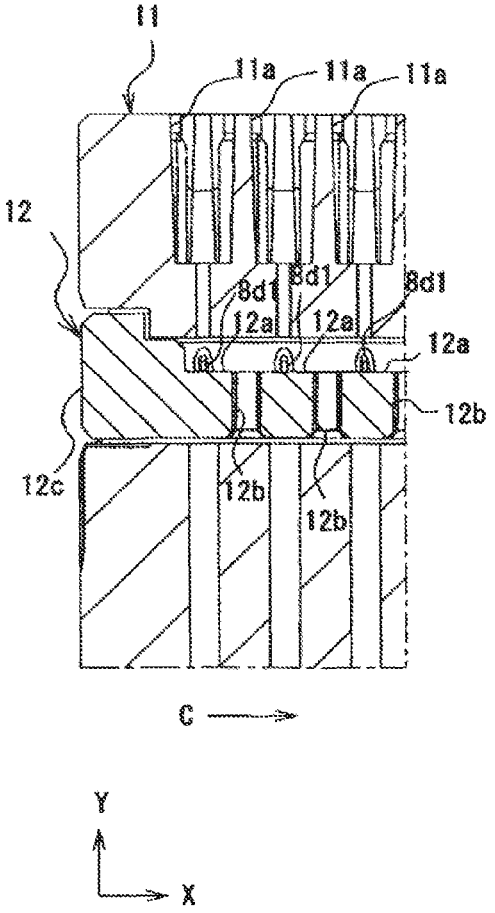

Subsequently, the retainer 12 is slid in the width direction X with respect to the socket housing 7 so as to be tuned into a locked state (see FIG. 31B). With the above, the lock portions 12a of the retainer 12 is moved to a position in the width direction X that is the same as the position where the lock portions 8d1 are inserted in the accommodation recesses 11a. With the above, even if the socket terminals 8 are pulled in the releasing direction from the terminal mounting holes 11c, the lock portions 8d1 are locked to the lock portions 12a and the socket terminals 8 are retained.

Furthermore, in the above case, if a portion of the lock portions 8d1 of the bead portions 8d of the socket terminals 8 are not inserted deep into the terminal mounting holes 11c and remains inside the insertion recesses 12b, the retainer 12 cannot be slid even if an attempt is made to slide the retainer 12 to a locked state since the lock portions 8d1 are caught inside the insertion recesses 12b. With the above, the operator can recognize that the socket terminals 8 are in a half-fitted state or in an incompletely fitted state.

As described above, the inner groove structure of the terminal mounting holes 11c on the upper row and that on the lower row are formed so as to be vertically inverted with respect to each other, and the socket terminals 8 that are inserted into the terminal mounting holes 11c are also vertically inverted. With the above, the lock portions 8d1 of the socket terminals 8 of the upper row are provided on the lower side and the lock portions 8d1 of the socket terminals 8 of the lower row are provided on the upper side, and the lock portions 8d1 of the socket terminals 8 of the upper row and the lower row are arranged at close positions in the height direction Z. Accordingly, by mere use of a single substantially rectangular parallelepiped shaped retainer 12 with a simple structure, all of the socket terminals 8 accommodated in the terminal mounting holes 11c can be retained.

Method of Fitting Plug Connector and Socket Connector to Each Other

As illustrated in FIGS. 32 and 33, in a state in which the socket terminals 8 are fixed to the socket housing 7, the socket connector 9 is inserted into the accommodation space 4f of the plug housing 4 through the fitting port 4e and is pushed deep into the accommodation space 4f. In such a case, the tips of the flat bar-like connection pieces 8a of the socket terminals 8 come into contact with the contact projections 5f of the fork-shaped terminal portions 5d of the plug terminals 5. When the contact projections 5f are pushed by the flat bar-like connection pieces 8a, the elastic contact pieces 5a become bent and are displaced in the height direction Z, and the flat bar-like connection pieces 8a are inserted deep into the contact recesses 5b while widening the gaps between the opposing contact projections 5f.

As described above, the contact edges 5g of the contact projections 5f in contact with the flat bar-like connection pieces 8a each include the front edge 5g1 and the rear edge 5g2 that are inclined surfaces with different angles of inclination with respect to the line extending in the insertion direction of the flat bar-like connection piece 8a. The front edge 5g1 and the rear edge 5g2 are provided continuously and the angle of inclination of the front edge 5g1 on the front side in the insertion direction of the flat bar-like connection piece 8a is smaller than the angle of inclination of the rear edge 5g2 on the rear side (see FIGS. 26 and 27). With the above, while the tip of the flat bar-like connection piece 8a is guided by the inclined surfaces towards the depth side in the insertion direction, the insertion force of the flat bar-like connection piece 8a is dispersed with the front edge 5g1 and the rear edge 5g2 that have different angles of inclination. As described above, the flat bar-like connection piece 8a can be inserted into the contact recess 5b with smaller insertion force; accordingly, the insertion property can be improved.

When the gap between the contact projections 5f is widened with the flat bar-like connection piece 8a, the elastic contact pieces 5a become deformed. In such a case, typically, due to twisting and oblique insertion, an unanticipated abnormal load is applied to the elastic contact pieces 5a causing plastic deformation in the elastic contact pieces 5a such that the elastic contact pieces 5a are, in some cases, unable to return to the regular contact position with respect to the flat bar-like connection piece 8a.

In contrast, in the connector 1, even if an abnormal load as described above is applied to the elastic contact pieces 5a and even if the opposing elastic contact pieces 5a are displaced in a direction widening the gap therebetween, the elastic contact pieces 5a will abut against the first wall portions 4g1 such that the displacement is restricted. Furthermore, in a similar manner, even if the elastic contact pieces 5a are displaced in the plate thickness direction, the elastic contact pieces 5a will abut against the second wall portions 4g2 such that the displacement is restricted. As described above, a situation such as the elastic contact pieces 5a not returning to the regular contact position with respect to the flat bar-like connection piece 8a will less likely occur. Furthermore, by partially covering the plug terminals 5 with the terminal accommodation portions 4g including the first wall portions 4g1 and the second wall portions 4g2, foreign matter will less likely adhere to the plug terminals 5.

Figure 34:
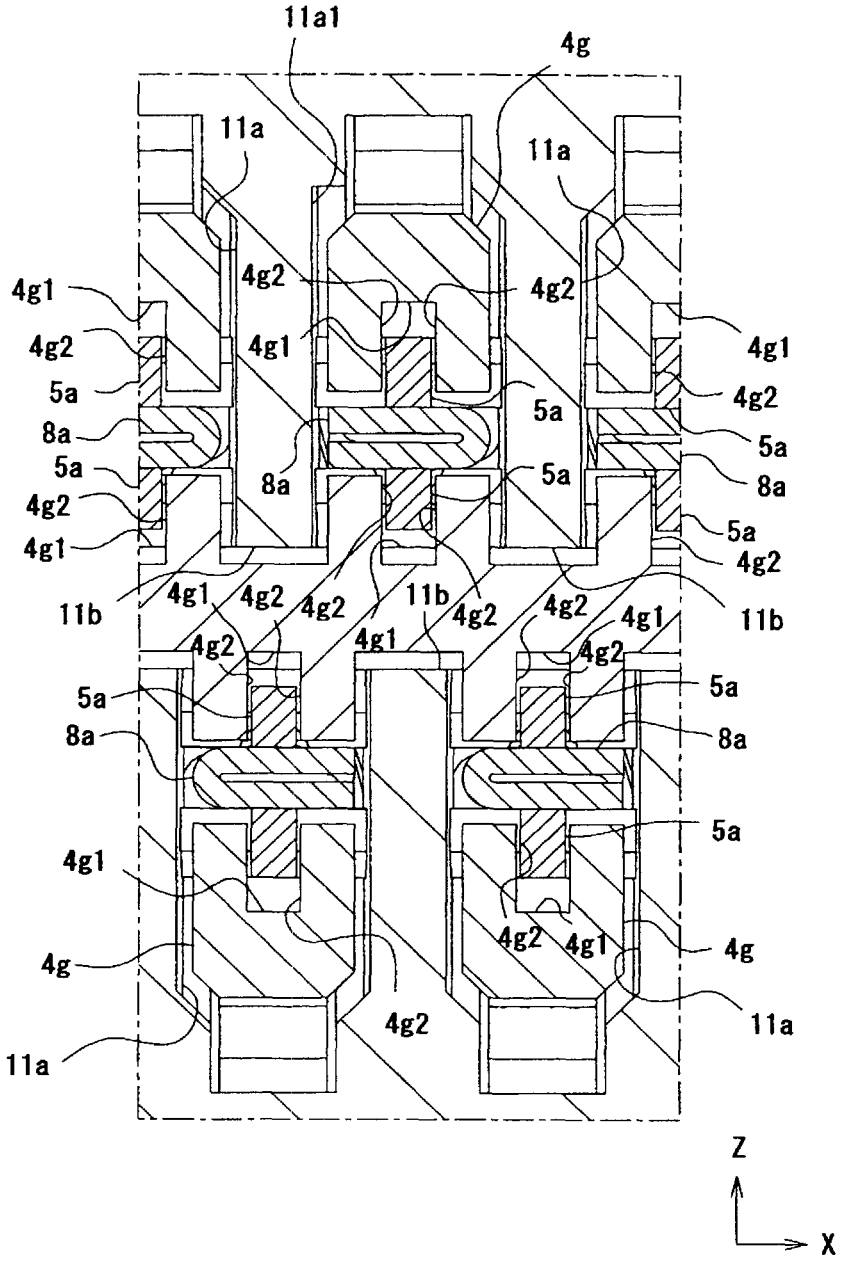
FIG. 34 is a cross-sectional view taken along a line indicated by arrows XXXIV-XXXIV of FIG. 33 and is an enlarged view of an accommodation recess.

An interval (an interval in the width direction X) between the second wall portions 4g2 included in a single terminal accommodation portion 4g is formed smaller than the plate width of the flat bar-like connection piece 8a (see FIG. 34). Accordingly, a situation such as the flat bar-like connection piece 8*a* getting in between the second wall portions 4*g*2 and excessively pushing the elastic contact pieces 5*a* can be prevented from occurring.

The two elastic contact pieces 5*a* included in the fork-shaped terminal portion 5*d* vertically oppose each other, and each of the elastic contact pieces 5*a* is accommodated in the terminal accommodation portion 4*g*. The flat bar-like connection piece 8*a* is, in the two terminal accommodation portions 4*g*, inserted between the vertically opposing second wall portions 4*g*2. In such a case, since the plate surfaces of the flat bar-like connection piece 8*a* and the end portions of the second wall portions 4*g*2 can be in sliding contact with each other, the end portions of the second wall portions 4*g*2 supporting the plate surfaces of the flat bar-like connection piece 8*a* can guide the flat bar-like connection piece 8*a* deep into the contact recess 5*b*. At the same time, each of the flat plate-shaped surfaces of the flat bar-like connection piece 8*a* are in sliding contact with the opposing and corresponding second wall portions 4*g*2 such that a certain insertion position is maintained. Accordingly, oblique insertion and twisting less likely occurs and a situation such as occurrence of plastic deformation and buckling of the elastic contact pieces 5*a* due to being pushed can be prevented from occurring.

The contact projections 5*f* of the two elastic contact pieces 5*a* and 5*a* included in the fork-shaped terminal portion 5*d* of the plug terminal 5 hold therebetween the flat bar-like connection piece 8*a*, which has been inserted from the opening 5*b*1 of the contact recess 5*b*, from the direction extending along the plate surface of the plug terminal 5 (the up-down direction) so as to be capable of reliably holding therebetween the flat bar-like connection piece 8*a* by a certain pressure. Furthermore, by configuring the connection piece 8*a* of the socket terminal 8 to have a flat bar shape and by configuring the connection piece 8*a* to have a width that is larger than the plate thickness of the plug terminal 5, compared with a case in which the connection piece is provided as a thin rod, for example, the connection piece 8*a* can be in conductive contact with the plug terminal 5 in a more stable manner. As described above, since the flat bar-like connection piece 8*a* and the fork-shaped terminal portion 5*d* can be in conductive contact with each other in a reliable manner, compared with a typical connector that forms a complicated box-shaped storage portion by bending a metal piece forming a socket terminal, the overall size of the connector can be reduced and connection reliability can be increased.

After inserting the socket connector 9 deep into the accommodation space 4*f* of the plug housing 4, the interpolar walls 11*b* separate the adjacent plug terminals 5 and the terminal accommodation portions 4*g* of the plug housing 4 and the plug terminals 5 are accommodated on the inner side of the accommodation recesses 11*a* of the socket housing 7. Accordingly, the portions between the plug terminals 5 that are adjacent to each other in the with direction X can be structurally insulated not only with the second wall portions 4*g*2 but also with the interpolar walls 11*b*. Furthermore, since the elastic contact piece 5*a* can be surrounded by the accommodation recess 11*a* of the socket housing 7 and the first wall portions 4*g*1 of the plug housing 4 from the plate surface direction and from the plate edge direction, occurrence of short-circuiting between the plug terminals 5 can be prevented in a reliable manner (see FIG. 34). At the same time, whisker prevention measures such as tin plating of the plug terminal 5 can be performed in a reliable manner.

The socket housing 7 includes surface contact portions 11*e*1 and 11*f*1. In a state in which the plug connector 6 and the socket connector 9 are fitted together, a load that pivots the socket connector 9 in the up-down direction with respect to the plug connector 6 is applied to the socket connector 9, the surface contact portions 11*e*1 and 11*f*1 comes into contact with the plug housing 4; accordingly, pivoting can be restricted. Accordingly, a situation such as the fitting port 4*e* of the accommodation space 4*f* of the plug housing 4 being pushed and widened by the socket housing 7 due to the above kind of twisting can be prevented from occurring.

Conventional on-vehicle connectors, even those of a minimum class that are specified for a rated amperage of 3 A, have 40 poles at a pitch of about 2.2 mm. Conversely, the connector 1 of the present exemplary embodiment can be reduced in size such that the connector 1 has 40 poles at a pitch of about 1.5 mm, for example; accordingly, the area occupied by the circuit board 3 can be reduced. Furthermore, if there is no need to have a rated amperage of 3 A, the electric wires that are used can be made thinner and further pitch reduction and size reduction can be achieved. Furthermore, since the plug terminals 5 are in conductive contact with the flat bar-like connection pieces 8*a* of the socket terminals 8 by holding the flat bar-like connection pieces 8*a* between the contact projections 5*f* of the contact recesses 5*b*, connection reliability is increased.

Modification

In the exemplary embodiment described above, the connector 1 specified for surface mount is exemplified, and the board fixing piece 5*h* that, from the base portions 5*c* towards the side that is opposite to the side in which the fixing pieces 5*e* and the fork-shaped terminal portion 5*d* are provided, extends in parallel with respect to the fixing pieces 5*e* and the fork-shaped terminal portion 5*d* is illustrated. Conversely, the connector 1 may be a connector specified for a dual in-line package (DIP) by forming each board fixing piece 5*h* to continuously extend in a linear manner from the base portion 5*c* in the circuit board 3 direction and fixing each board fixing piece 5*h* in a through hole (not shown) provided in the circuit board 3.

In the exemplary embodiment described above, the connector 1 in which the linear conductors 2 are arranged in two upper and lower rows is exemplified. Conversely, in accordance with the current value, the linear conductors 2 may be arranged in a single row or in three rows or more. In such a case, in accordance with the arrangement of the linear conductors 2, the arrangement of the plug terminals 5, the number of rows of the terminal accommodation portions 4*g* of the plug housing 4, the accommodation recesses 11*a* of the socket housing body 11, the terminal mounting holes 11*c*, and the insertion recesses 12*b* of the retainer 12 may be changed.

What is claimed is:

1. A connector, comprising:

a plug connector including a plug housing that includes an accommodation space in which a socket housing is inserted and a plurality of plug terminals, the plug connector being fixed to a circuit board; and a socket connector including a socket housing that is inserted into and fitted to the plug housing, and a plurality of socket terminals that are in conductive contact with the plug terminals, wherein the socket terminals include flat bar-like connection pieces that are in conductive contact with the plug terminals, the plug terminals are formed of flat plate-shaped metal pieces, the plug terminals being fixed to the plug housing while plate surfaces of the plug terminals extend in a height direction of the plug housing, the plug terminals including terminal portions that are in conductive contact with the socket terminals, the socket housing includes accommodation recesses that include openings provided in a front surface on a plug housing insertion side, the flat bar-like connection pieces of the socket terminals protruding towards the openings, the plug housing includes terminal accommodation portions that accommodate the terminal portions of the plug terminals therein, the terminal accommodation portions being inserted in the accommodation recesses when the plug housing is fitted into the socket housing, and the flat bar-like connection pieces of the socket terminals and the terminal portions of the plug terminals are in conductive contact with each other inside the terminal accommodation portions.

2. The connector according to claim 1, wherein the terminal portions include contact recesses that are formed in recessed shapes that have openings in plate edges of the flat plate-shaped metal pieces on a socket terminal insertion side, the contact recesses being in conductive contact with the flat bar-like connection pieces of the socket terminals that have been inserted through the openings, by holding the flat bar-like connection piece between the contact recesses in a direction extending along the plate surface of the plug terminals.

3. The connector according to claim 1, wherein the socket terminals include bead portions, the socket housing includes terminal mounting holes into which the socket terminals are inserted and a retainer that is disposed in a crossing direction of the terminal mounting holes and that is capable of moving in the crossing direction, and the retainer includes insertion recesses that allow the bead portions to be inserted therein by moving in the crossing direction and by communicating with the terminal mounting holes at time of inserting the socket terminals, and lock portions that lock the bead portions in a releasing direction by moving in the crossing direction at time of locking that retains the socket terminals that have been inserted in the terminal mounting holes.

4. The connector according to claim 1, wherein the socket housing includes interpolar walls that divide adjacent plug terminals from each other when in a state in which the socket housing is fitted together with the plug housing.

5. The connector according to claim 2, wherein the terminal portions form fork-shaped terminal portions that branches into two forks, the fork-shaped terminal portions including contact pieces that are capable of being displaced in the direction extending along the plate surface, the contact recesses being formed by recess-shaped plate edges provided between the contact pieces.

6. The connector according to claim 5, wherein the terminal accommodation portions include first wall portions that restrict excessive displacement in directions widening gaps between the contact pieces when the fork-shaped terminal portions are in conductive contact with the socket terminals.

7. The connector according to claim 6, wherein the terminal accommodation portions include second wall portions that restrict deviating displacement of the contact pieces in a plate thickness direction when the flat bar-like connection pieces of the socket terminals are inserted into the contact recesses and are in conductive contact with the contact recesses.

8. The connector according to claim 2, wherein the socket housing includes interpolar walls that divide adjacent plug terminals from each other when in a state in which the socket housing is fitted together with the plug housing, the terminal portions form fork-shaped terminal portions that branches into two forks, the fork-shaped terminal portions including contact pieces that are capable of being displaced in the direction extending along the plate surface, the contact recesses being formed by recess-shaped plate edges provided between the contact pieces, terminal accommodation portions including first wall portions that restrict excessive displacement in directions widening gaps between the contact pieces when the fork-shaped terminal portions are in conductive contact with the socket terminals, and second wall portions that restrict deviating displacement of the contact pieces in a plate thickness direction when the flat bar-like connection pieces of the socket terminals are inserted into the contact recesses and are in conductive contact with the contact recesses, the second wall portions are formed on both sides of the contact pieces in a direction extending along a length of the contact piece, and the interpolar walls are disposed between adjacent second wall portions when in a state in which the plug housing and the socket housing are fitted together.

9. The connector according to claim 5, wherein the contact pieces include, at the distal end side thereof, contact projections that project in a socket terminal contact direction so as to be in conductive contact with the flat bar-like connection pieces of the socket terminals, the contact projections including contact edges in which inclined surfaces continuously extend in multiple steps from a front side to a back side in an insertion direction of the flat bar-like connection pieces such that an angle of inclination of the inclined surfaces become smaller with respect to a line that extends in the insertion direction.

10. The connector according to claim 5, wherein the plug terminals include a plurality of fixing pieces that extend in parallel to the fork-shaped terminal portions of the terminal portions and that are fixed to the plug housing, the plurality of fixing pieces being disposed so as to hold the terminal portions in between.

11. The connector according to claim 1, wherein the socket housing includes terminal mounting holes of the socket terminals that are formed in two rows in the height direction, and a retainer that is disposed between one of the rows of the terminal mounting holes and the other one of the rows of the terminal mounting holes among the two rows of the terminal mounting holes, the retainer locking the plurality of socket terminals accommodated in the two rows of the terminal mounting holes in a releasing direction.

12. The connector according to claim 1, wherein the socket terminals include tab portions provided on proximal end sides of the flat bar-like connection pieces, the tab portions locking the socket terminals with respect to the socket housing, and bead portions provided across the flat bar-like connection pieces and the tab portions.

13. A connector, comprising:

a socket housing that is inserted into and fitted to an accommodation space of a plug housing of a plug connector; and socket terminals that is in conductive contact with plug terminals provided in the plug housing, wherein the socket terminals include flat bar-like connection pieces that are in conductive contact with the plug terminals, and the socket housing includes accommodation recesses that include openings provided in a front surface on a plug housing insertion side, the flat bar-like connection pieces of the socket terminals protruding towards the openings, wherein the socket terminals include bead portions, the socket housing includes terminal mounting holes into which the socket terminals are inserted and a retainer that is disposed in a crossing direction of the terminal mounting holes and that is capable of moving in the crossing direction, and the retainer includes insertion recesses that allow the bead portions to be inserted therein by moving in the crossing direction and by communicating with the terminal mounting holes at time of inserting the socket terminals, and lock portions that lock the bead portions in a releasing direction by moving in the crossing direction at time of locking that retains the socket terminals that have been inserted in the terminal mounting holes.

14. A connector, comprising:

a socket housing that is inserted into and fitted to an accommodation space of a plug housing of a plug connector; and socket terminals that is in conductive contact with plug terminals provided in the plug housing, wherein the socket terminals include flat bar-like connection pieces that are in conductive contact with the plug terminals, and the socket housing includes accommodation recesses that include openings provided in a front surface on a plug housing insertion side, the flat bar-like connection pieces of the socket terminals protruding towards the openings, wherein the socket housing includes terminal mounting holes of the socket terminals that are formed in two rows in the height direction, and a retainer that is disposed between one of the rows of the terminal mounting holes and the other one of the rows of the terminal mounting holes among the two rows of the terminal mounting holes, the retainer locking the plurality of socket terminals accommodated in the two rows of the terminal mounting holes in a releasing direction.

* * * * *